US007770427B2

(12) United States Patent
Nakahara et al.

(10) Patent No.: US 7,770,427 B2
(45) Date of Patent: Aug. 10, 2010

(54) METAL FORGED PRODUCT, UPPER OR LOWER ARM, PREFORM OF THE ARM, PRODUCTION METHOD FOR THE METAL FORGED PRODUCT, FORGING DIE, AND METAL FORGED PRODUCT PRODUCTION SYSTEM

(75) Inventors: Takafumi Nakahara, Kitakata (JP); Mitsuharu Akiyama, Kitakata (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/546,043

(22) PCT Filed: Feb. 18, 2004

(86) PCT No.: PCT/JP2004/001837

§ 371 (c)(1),
(2), (4) Date: Mar. 9, 2006

(87) PCT Pub. No.: WO2004/073903

PCT Pub. Date: Sep. 2, 2004

(65) Prior Publication Data

US 2006/0185416 A1 Aug. 24, 2006

Related U.S. Application Data

(60) Provisional application No. 60/448,531, filed on Feb. 21, 2003.

(30) Foreign Application Priority Data

Feb. 18, 2003 (JP) ..... 2003-039140
Sep. 16, 2003 (JP) ..... 2003-322929

(51) Int. Cl.
*B21D 22/02* (2006.01)
*B21D 22/00* (2006.01)
*B21C 51/00* (2006.01)

(52) U.S. Cl. ..... 72/358; 72/352; 72/356; 72/14.8

(58) Field of Classification Search ..... 72/255, 72/356, 360, 358, 359, 352, 354.2, 14.8, 72/15.2, 15.5
See application file for complete search history.

(56) References Cited

U.S. PATENT DOCUMENTS 1,373,726 A * 4/1921 Heiby et al. ..... 72/40
6,151,948 A 11/2000 Ashworth et al.
6,678,574 B2 * 1/2004 Fujii et al. ..... 700/145
2004/0093926 A1 * 5/2004 Natsui et al. ..... 72/377

FOREIGN PATENT DOCUMENTS

JP 1-166842 A 6/1989

(Continued)

*Primary Examiner*—Dana Ross
*Assistant Examiner*—Debra M Sullivan
(74) *Attorney, Agent, or Firm*—Sughrue Mion, PLLC

(57) ABSTRACT

A method for producing a metal forged product having a plurality of branches includes a preliminary forging step of forming a preform by closed forging from a cylindrical material (301) having a surface layer (302) on a circumferential surface thereof such that the surface layer is contained in a surface region of the preform; an intermediate forging step of subjecting the preform to forging to thereby extrude the surface layer in the form of flash outside a periphery of a forged product corresponding to a target product; a final forging step of forging the forged product into a product assuming a target product shape; and a flash removal step of removing the flash containing the surface layer from the product assuming a target product shape to thereby produce a target forged product. The forged product is enhanced in mechanical characteristics and has no flash removal mark. Since the cylindrical material having a surface layer on a circumferential surface thereof is used, the power required for the steps can be reduced to enhance the yield of the products on the basis of the forging material.

15 Claims, 17 Drawing Sheets

FOREIGN PATENT DOCUMENTS

| | | | | |
|---|---|---|---|---|
| JP | 3-23028 | A | | 1/1991 |
| JP | 04-309430 | A | | 11/1992 |
| JP | 6-126374 | A | | 5/1994 |
| JP | 06-184605 | A | | 7/1994 |
| JP | 10-118735 | A | | 5/1998 |
| JP | 10118735 | A | * | 5/1998 |
| JP | 2002-361354 | A | | 12/2002 |
| WO | WO 02/078875 | A1 | | 10/2002 |

* cited by examiner (a)

(b)

(c)

(a) (b)

(b)

(c)

(a)

(b)

METAL FORGED PRODUCT, UPPER OR LOWER ARM, PREFORM OF THE ARM, PRODUCTION METHOD FOR THE METAL FORGED PRODUCT, FORGING DIE, AND METAL FORGED PRODUCT PRODUCTION SYSTEM

CROSS REFERENCE TO RELATED APPLICATIONS

This application is an application filed under 35 U.S.C. §111(a) claiming the benefit pursuant to 35 U.S.C. §119(e)(1) of the filing date of Provisional Application Ser. No. 60/448,531 filed Feb. 21, 2003 pursuant to 35 U.S.C. §111(b).

TECHNICAL FIELD

The present invention relates to a metal forged product, an upper or lower arm, a preform of the arm, a method for producing the product, a forging die, and a metal forged product production system.

BACKGROUND ART

Recently, in place of iron material, aluminum alloy has been increasingly employed for producing suspension parts for vehicles in order to reduce the weight of the parts. Particularly, the suspension parts for vehicles have been produced through forging in order to enhance their mechanical strength and to reduce the amount of raw material employed for producing a product. Examples of the parts employed in a vehicle suspension include an upper arm and a lower arm.

Since an upper arm 54 shown in FIG. 5, which is a suspension part for a vehicle, has branches 51, 52 and 53 extending in three directions, difficulty is encountered in producing the upper arm in a single forging step. Therefore, conventionally, the upper arm has been produced as follows: firstly, a preform 61 as shown in FIG. 6 having a shape similar to that of a target product is produced through forging, and subsequently, the preform is subjected to a plurality of forging steps to thereby produce the upper arm 54 shown in FIG. 5.

Specifically, a solid round bar material 71 as shown in FIG. 7 is subjected to forging by use of a forging die to thereby yield a forged product having a flash 72 formed at its periphery. Subsequently, the flash 72 is removed from the forged product by use of a trimming die to thereby yield a preform 73. Thereafter, the preform 73 is subjected to a plurality of forging steps to thereby produce an upper arm 74. In this case, in order to reduce loss of the material incurred by formation of the flash 72, there is employed a forging die having a configuration allowing a plurality of forged products 73*a* to be produced from one solid round bar material 71 in a single step.

JP-A HEI 1-166842 discloses a method for producing, through closed forging, a product having a plurality of branches. In the prior art method for producing a product having a plurality of radially extending branches, as shown in FIG. 8, a punch 91 is used to apply pressure to a solid round bar material serving as a raw material so as to fill impressions provided in dies 93 and 94 to thereby form radially extending branches 92 through closed forging.

JP-A HEI 10-118735 also discloses a method for producing, through closed forging, a product having a plurality of branches. This method uses a casting-forging die that has a metal reservoir portion having a thickness larger than a modified surface layer of a forging material and that is provided between the inner surface of a die block, which inner surface is in parallel to a forging direction, and the outer surface of a punch. The casting-forging die also has a convex fringe portion provided on the outer surface of the punch for facilitating removal of a forged product. A cast material (forging material) is set in position inside the die block, and a forged product is formed through closed forging, with the modified surface layer of the forging material remaining in the metal reservoir portion.

Also, JP-A 2002-361354 discloses a method for producing, through closed forging, a product having a plurality of branches. This closed forging method employs, as a forging material, a cylindrical cast ingot comprising an upper surface and a lower surface each containing no angular portion and a circumferential surface, having the same volume as a preform and assuming a shape such that the ratio of the lateral length of a projection profile of the forging material to the length of the forging material as measured in the direction of pressure application is 1 or less, in which the profile is formed in a direction perpendicular to the direction of pressure application. In this method, pressure is applied onto the circumferential surface of the forging material to thereby produce a preform 15 of an upper arm or lower arm that is a suspension part for a vehicle.

The aforementioned conventional method for producing a preform of an upper arm or lower arm that is a suspension part for a vehicle requires a trimming step for removing flashes subsequent to a forging step. In this method, since unwanted flashes are formed on the preform, the yield of the preform on the basis of a forging material is low. In addition, since the projection area of the preform (i.e., forged product) as viewed in the direction of pressure application is large, a large, expensive forging machine capable of applying high load is required, resulting in high production cost.

In the closed forging method disclosed in JP-A HEI 1-166842, pressure is applied in a direction perpendicular to the cut surface of a cylindrical material so as to cause plastic flow of the material, thereby forming radially extending branches 92 (FIG. 8). Therefore, when the branches 92 are long or have different shapes, forging defects, such as underfill and overlap, on the surface of a forged product may be generated, because of differences in the rate or direction of plastic flow of the material between portions of the forged product.

In the closed forging method disclosed by JP-A HEI 10-118735, since the surface layer is extruded through tightly sealed forging, the load required for forging becomes large, resulting in possibly shortening the service life of the die. In addition, since restrictions are imposed on the balance matching in volume between the forging material and the forged product, there is a fair possibility of underfills being generated in the forged product due to balance mismatching.

Meanwhile, JP-A 2002-361354 does not disclose a specific step required for producing a target product from a preform although it discloses a method for forming the preform.

In view of the foregoing, objects of the present invention are to provide a forging method for producing a metal forged product having a plurality of branches, in which the yield of a target product on the basis of a raw material is improved; to provide a die employed in the forging method; and to provide a production system employing the die.

Another object of the present invention is to provide a method for producing a suspension part for vehicles and a preform of the part at low cost and in an efficient manner.

The term "material" as used herein refers to a product that has not yet been subjected to forging. The material encompasses cast ingot, forging material, cut material, solid round bar material, raw material, solid round bar, solid round bar raw material, cylindrical raw material, round bar material, continuously cast round bar, disk and billet material.

The term "preform" as used herein refers to a product which is obtained through forging and which requires one or more forging steps in order to be formed into a target product. The preform encompasses a blank, a rough forging blank and a rough blank.

The term "forged product" as used herein refers to a target product produced through forging. The forged product encompasses a member, a product, a final product, a forged final product and a final product produced through forging.

DISCLOSURE OF THE INVENTION

The present invention provides a method for producing a metal forged product having a plurality of branches, comprising a preliminary forging step of forming a preform by closed forging from a cylindrical material having a surface layer on a circumferential surface thereof such that the surface layer is contained in a surface region of the preform and a forging step of subjecting the preform to forging to thereby extrude the surface layer in the form of flash outside a periphery of a forged product corresponding to a target product.

The present invention also provides a method for producing a metal forged product having a plurality of branches, comprising a preliminary forging step of forming a preform by closed forging from a cylindrical material having a surface layer on a circumferential surface thereof such that the surface layer is contained in a surface region of the preform, an intermediate forging step of subjecting the preform to forging to thereby extrude the surface layer in the form of flash outside a periphery of a forged product corresponding to a target product, a final forging step of forging the forged product into a product assuming a target product shape, and a flash removal step of removing the flash containing the surface layer from the product assuming a target product shape to thereby produce a target forged product.

In each of the methods described above, the surface layer is a layer containing a portion formed of any one of species selected from among a casting surface, an inverse segregation layer and an oxide-containing layer, or a combination of two or more of the species, the surface layer is a layer having a thickness of 5 mm or less as measured from the circumferential surface of the cylindrical material, and the surface region of the preform has a thickness of 7 mm or less as measured from a surface of the preform.

In each of the methods described above, the cylindrical material serves as a forging material that has an upper surface and a lower surface each containing no angular portion and a circumferential surface, has the same volume as the preform, assumes a shape such that a ratio of a lateral length of a projection profile of the forging material to the length of the forging material as measured in a direction of pressure application is 1 or less, in which the profile is formed in a direction perpendicular to the direction of pressure application; the preliminary forging step includes disposing the forging material in a posture such that the upper and lower surfaces correspond to parallel surfaces of the preform and applying pressure onto the circumferential surface of the forging material; and the forging material is a cylindrical cut piece having a volume same as a volume (V) of the preform, wherein a ratio T/R of a thickness (T) of the piece to a diameter (R) of the piece is 1 or less, wherein the volume (V) of the preform, the thickness (T) of the piece, a longitudinal length (L) of the projection profile of the preform as viewed in the direction of pressure application, and the diameter (R) of the piece satisfy $(1/3)\times L \leqq R = 2\times(V/T\pi)^{1/2} \leqq L$, and wherein the thickness (T) of the piece is (0.8 to 1.0)×(the lateral length (t) of the projection profile of the preform as viewed in the direction of pressure application).

In each of the methods described above, the forging step or intermediate forging step is performed in a state in which, in a cavity region of a forging die in which a portion of the preform that has a thickness smaller than that of a corresponding portion of a forged product is subjected to forging, the surface region of the preform is located above a surface-layer-extruding section provided outside a section of the cavity, which section determines the shape of a forged product (hereinafter the section may be referred to simply as a "product-shape-determining section"); and in a state in which, in a cavity region in which a portion of the preform that has a thickness greater than that of a corresponding portion of a forged product is subjected to forging, the surface region of the preform is located inward from an end, on a side of the section, of a portion of the cavity, which portion is provided outside the section and has a level equal to or lower than that of the section.

In each of the methods described above, the forging material is formed of aluminum or an aluminum alloy.

In each of the methods described above, the forged product is an upper arm or a lower arm, which is a suspension part for a vehicle.

The present invention also provides an upper arm or a lower arm that is a suspension part for a vehicle, produced by each of the methods described above and having a branch in which metal flow (metal flow lines) at a center portion of a cross section of the branch run in a longitudinal direction of the branch.

The present invention also provides a preform produced by closed forging and used for forming a forged product, which preform contains in a surface region thereof a surface layer of a forging material, has metal flow in a longitudinal direction of a branch thereof and has no flash removal mark on the surface region.

In the preform, the surface layer is any one of species selected from among a casting surface, an inverse segregation layer and an oxide-containing layer, or a combination of two or more of the species, and the surface region has a thickness of 5 mm or less as measured from the surface of the preform.

The preform is used for forming a forged product and has a shape such that a portion of the preform having a volume smaller than that required for a corresponding portion of the product has a larger peripheral width than the corresponding portion of the product and such that a portion of the preform having a volume larger than that required for the corresponding portion of the product has a smaller peripheral width than the corresponding portion of the product.

In the preform, the product is an upper or lower arm that is a suspension part for a vehicle.

The present invention also provides a die used for the preliminary forging step of each of the methods described above, comprising a punch and die blocks and having a cavity that includes a forging space which is designed such that there can be produced therein a preform having a surface layer in its surface region and no flash removal mark on the surface region, having a plurality of branches and having metal flow in a longitudinal direction of the branches.

The die has a horizontally separable structure and includes means for uniting and holding separate die blocks.

In the die, the means is any one of species selected from among a holder ring and a driving mechanism, or a combination of the species.

The present invention also provides a die used for the intermediate forging step of each of the methods described above, comprising a punch and die blocks and having a cavity that includes a forging space which is designed such that a surface layer of a preform contained in a surface region thereof can be extruded in the form of flash outside a product-shape-determining section of the cavity.

In the die just mentioned above, the cavity is designed such that, in a cavity region in which a portion of the preform having a thickness smaller than that of a corresponding portion of a forged product is subjected to forging, a surface-layer-extruding section is provided outside a product-shape-determining section of the cavity so surface-layer-extruding section and such that, in a cavity region in which a portion of the preform having a thickness greater than that of a corresponding portion of the product is subjected to forging, a surface-layer-extruding section whose level is equal to or lower than that of a product-shape-determining section is provided outside the product-shape-determining section.

The present invention also provides a production system for producing a metal forged product having a plurality of branches, which system comprises a material-cutting apparatus and a forging apparatus.

As described above, the method of the present invention for producing a metal forged product comprises a preliminary forging step of forming a preform by closed forging from a cylindrical material having a surface layer on a circumferential surface thereof such that the surface layer is contained in a surface region of the preform and a forging step of subjecting the preform to forging to thereby extrude the surface layer in the form of flash outside a periphery of a forged product corresponding to a target product. Therefore, the forging material plastic-flows into a plurality of branches of a forged product, thereby enhancing mechanical characteristics. Furthermore, the forged product has no flash removal mark, and the cylindrical material having a surface layer on a circumferential surface thereof is used, thereby enabling the power required for the steps to be reduced. As a result, the yield of the products on the basis of the forging material can be enhanced.

Figure 23:
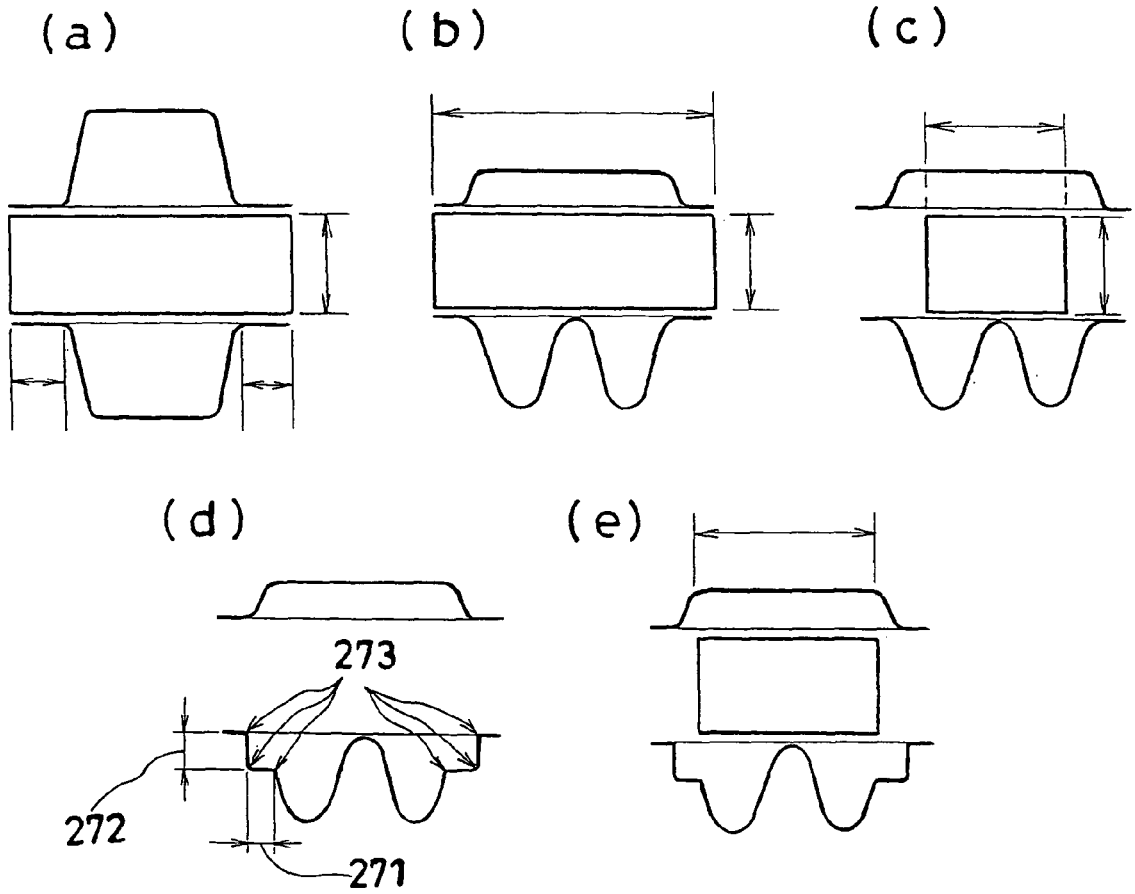
FIG. 23 is an explanatory view showing an embodiment of the die of the present invention for the intermediate forging step and showing how to design a preform, FIG. 23(*a*) showing a part of the die and a forging material having a cross-sectional area equal to that of a forged product, FIG. 23(*b*) showing another part of the die and a forging material having a cross-sectional area larger than that of a forged material, FIG. 23(*c*) showing the part of the die shown in FIG. 23(*b*) and a forging material having a cross-sectional area equal to that of a forged product, FIG. 23(*d*) showing a part of another die prepared in view of the surface layer being extruded when forging is performed in the state shown in FIG. 23(*c*) and FIG.

23(*e*) the part of the die shown in FIG. 23(*d*) and a forging material having a cross-sectional area equal to that of a forged product.

Figure 24:
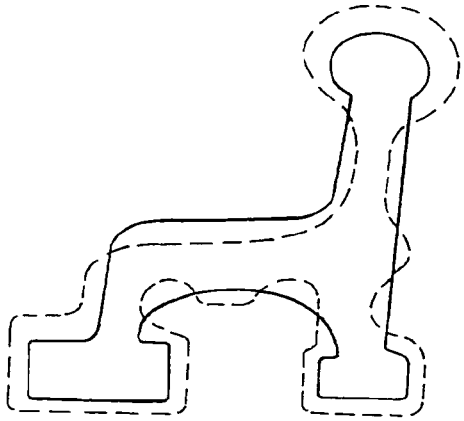

FIG. 24 is an explanatory view showing an example of the relation between the shape of a forged product and the shape of a preform used in the production method of the present invention.

Figure 25:
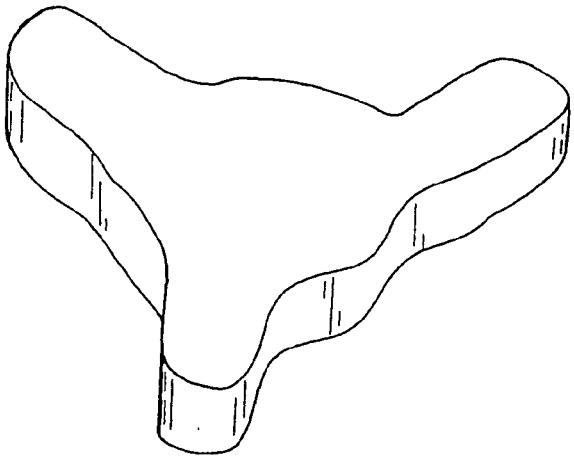

FIG. 25 shows the appearance of a preform to be forged into a forged product of another embodiment of the present invention.

Figure 26:
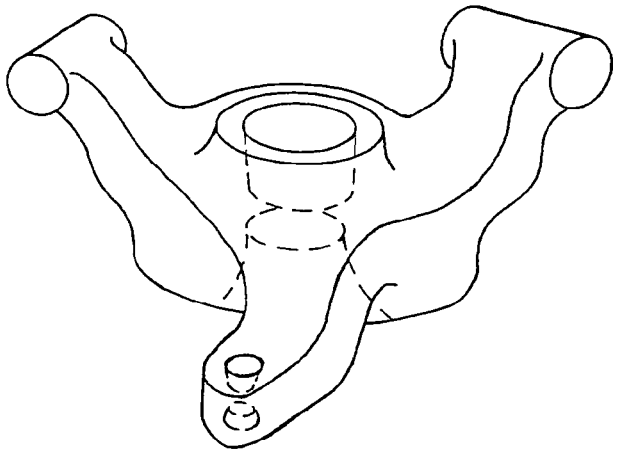

FIG. 26 shows the appearance of the metal forged product obtained from the preform of FIG. 25 subjected to a plurality of the intermediate forging steps and the final forging step.

Figure 27:
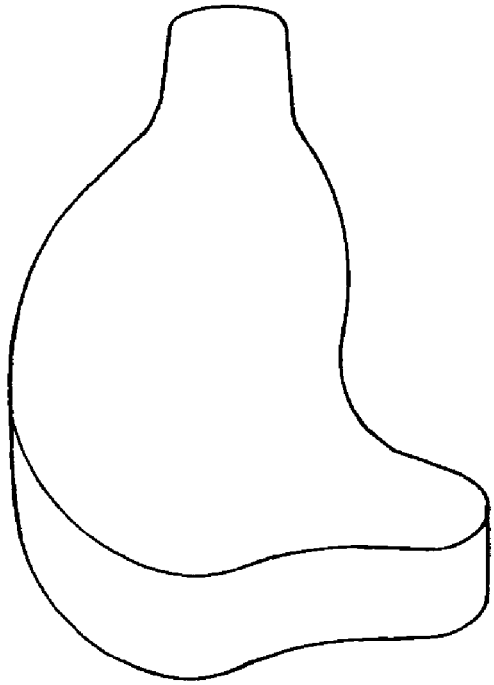

FIG. 27 shows the appearance of a preform to be forged into a forged product of another embodiment of the present invention.

Figure 28:
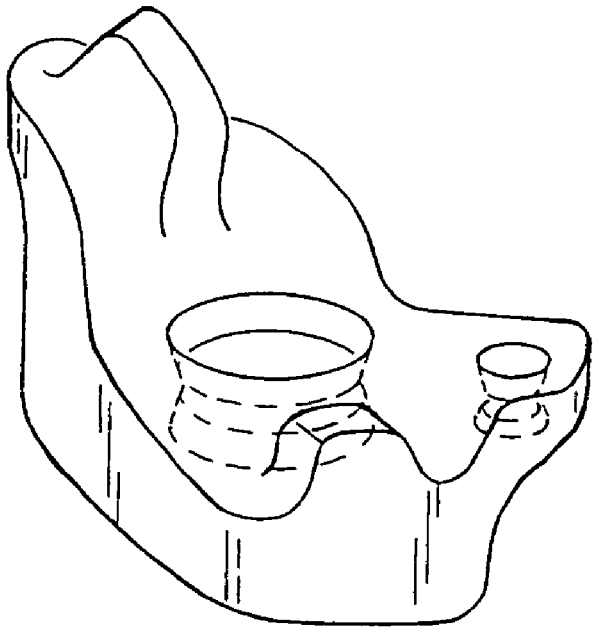

FIG. 28 shows the appearance of the metal forged product obtained from the preform of FIG. 27 subjected to a plurality of the intermediate forging steps and the final forging step.

Figure 29:
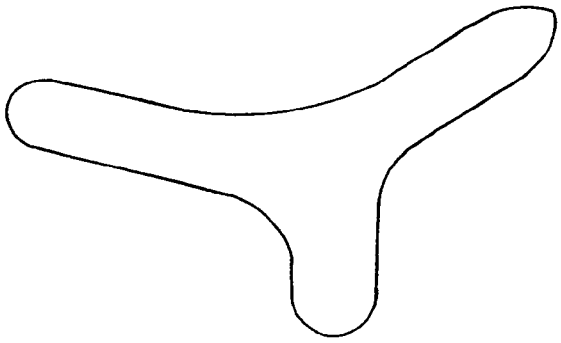

FIG. 29 shows the appearance of the rough forging preform that has encountered the final forging step.

Figure 30:
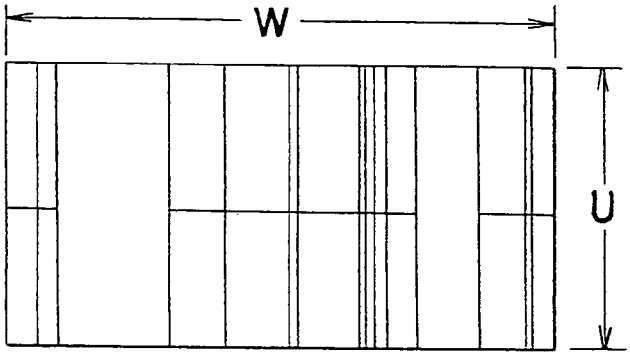

FIG. 30 shows a projection profile perpendicular to the direction of pressure application used in producing the rough forging preform shown in FIG. 29.

Figure 31:
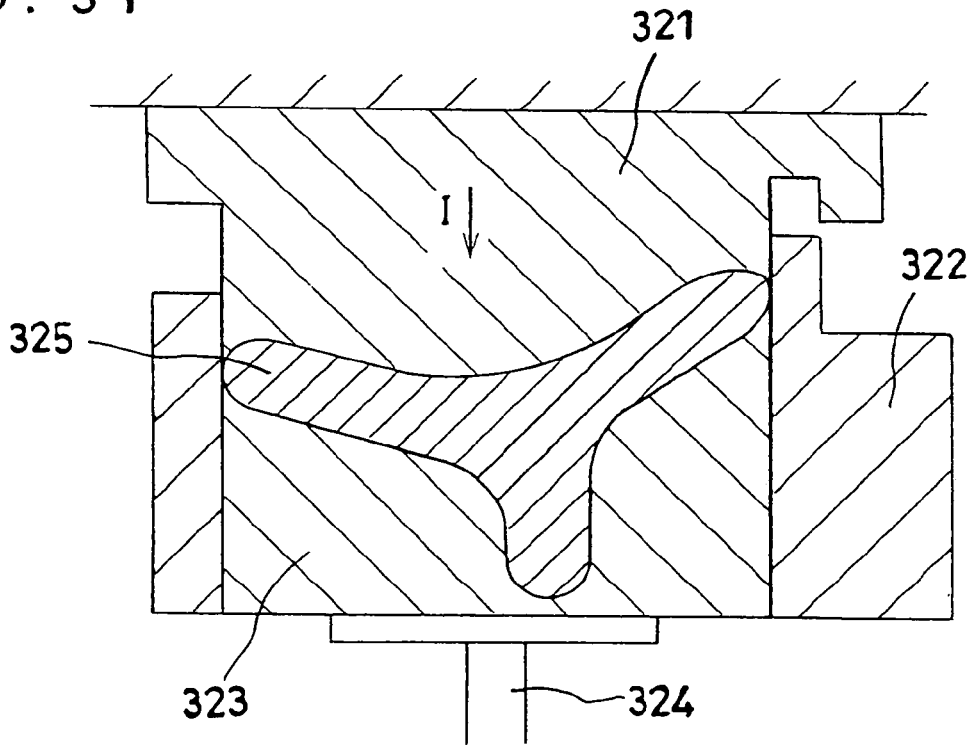

FIG. 31 is a cross-sectional view showing the state where the final forging step for producing the preform shown in FIG. 29 has been conducted.

Figure 32:
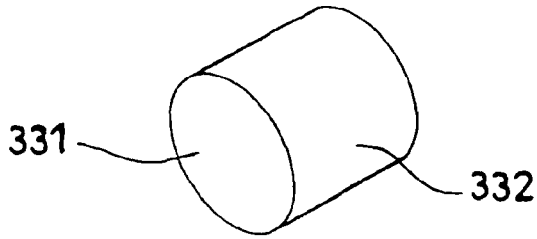

FIG. 32 shows the appearance of the material used in the present invention.

Figure 33:
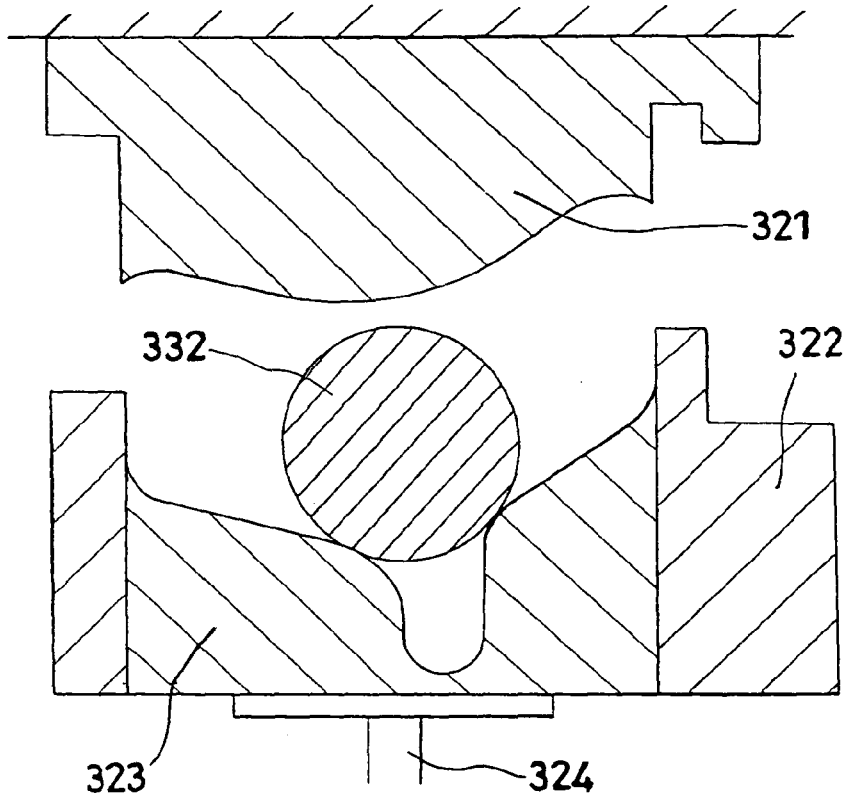

FIG. 33 shows the state where the material shown in FIG. 32 is placed in the die before forging.

Figure 34:
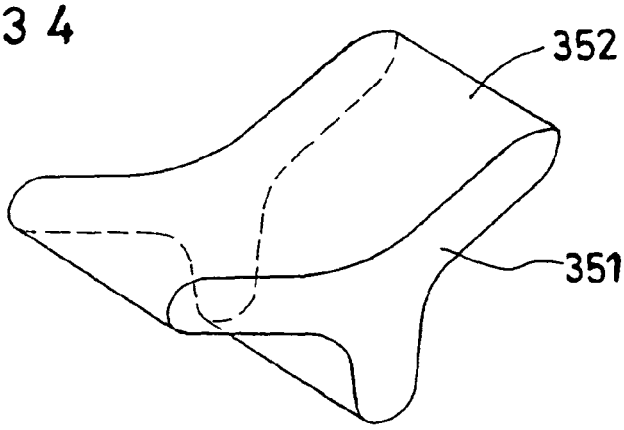

FIG. 34 shows the appearance of the preform forged with the die shown in FIG. 31.

Figure 35:
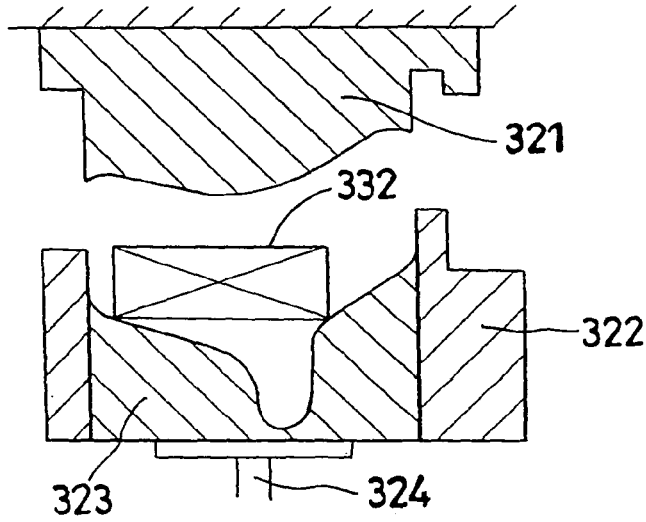

FIG. 35 is a cross section showing the state where the material is introduced into the die at a position where the cut surface of a cut piece is in agreement with a surface of the preform having its short axis.

Figure 36:
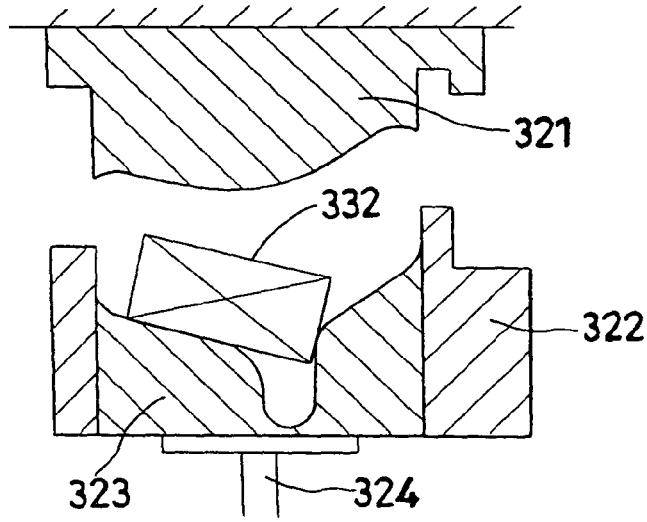
Figure 36:
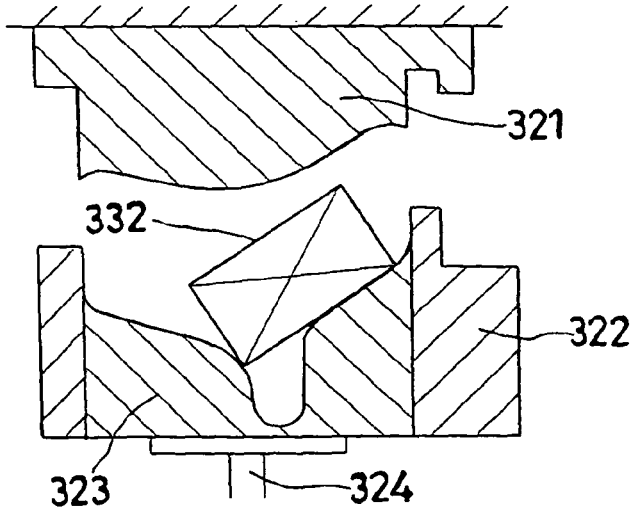

FIG. 36 is a cross section showing the state where the material is introduced to the die, FIG. 36(*a*) showing an example of arrangement of the preform and die and FIG. 36(*b*) showing another example of arrangement of the preform and die.

BEST MODE FOR CARRYING OUT THE INVENTION

The present inventors have performed extensive studies on a method for producing a forged product and a production system thereof, improvement of the yield of a target product on the basis of a raw material, and the relation between metal flow in a forged product and the mechanical strength of the product. The present invention has been accomplished on the basis of the results of the studies.

Figure 2:
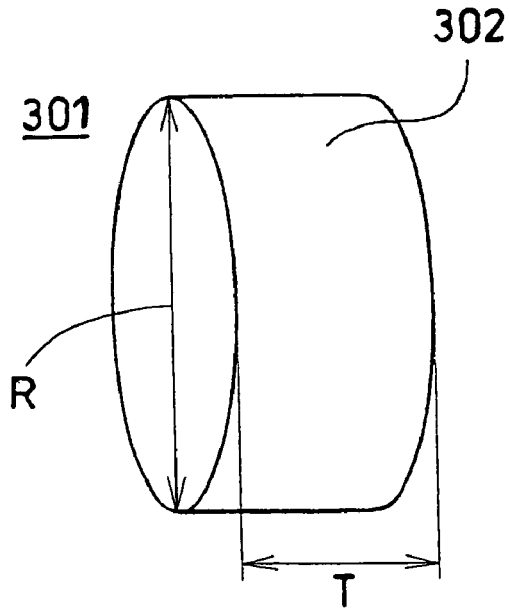
FIG. 2 shows the appearance of an example of a forging material employed in the present invention.

The forging material employed in the present invention assumes a cylindrical shape and has a surface layer on its circumferential surface. FIG. 2 shows a cylindrical (disk-shaped) material 301 having a surface layer 302 on its circumferential surface and having a diameter R and a thickness T, which is an example of the forging material.

The surface layer is defined as a layer containing a portion that may cause lowering of the quality of a forged product; i.e., a portion whose presence is undesirable in a target forged product. For example, the surface layer is a layer containing a portion formed of any one of species selected from among a casting surface, an inverse segregation layer and an oxide-containing layer, or a combination of two or more of the species. Alternatively, the surface layer is defined as a layer having a thickness of 5 mm or less (preferably 2 mm or less, more preferably 1.5 mm or less) as measured from the circumferential surface of the cylindrical material. The surface layer encompasses an "as-cast" casting surface of a continuously cast alloy bar and a modified casting surface after long-term storage.

Since the surface layer of a forging material may cause lowering of the quality of the resultant forged product, conventionally, the surface layer has been removed from the forging material by means of, for example, machining, and the resultant material has been subjected to forging. In contrast, in the production method of the present invention, a forging material having a surface layer can be subjected to forging without any preliminary treatment of the material, and thus a step of removing the surface layer is omitted. In addition, lowering of the yield of a forged product on the basis of the forging material, which is caused by removal of the surface layer, can be prevented, and therefore productivity is enhanced.

Preferably, the forging material employed in the present invention is a cylindrical cast ingot which has the same volume as a perform and assumes a shape having an upper surface and a lower surface each containing no angular portion and a circumferential surface and such that the ratio of the lateral length of a projection profile of the ingot, which profile is formed in a direction perpendicular to the direction of pressure application, to the length of the ingot as measured in the direction of pressure application is 1 or less.

The expression "a forging material has the same volume as a preform" as used herein refers to the case where the volume of the forging material falls within the range of an acceptable volume tolerance of the preform. The difference in volume between the forging material and the preform is preferably 2% or less, more preferably 1% or less, on the basis of the volume of the preform.

When the volume of a forging material is not the same as that of a preform, problems arise. For example, when the volume of a preform is greater than that of a forging material, underfill occurs in the preform. Meanwhile, when the volume of a preform is smaller than that of a forging material, since flashes are formed on the preform, the preform cannot be used as a forged product, or a forging die is broken. In the case where flashes are formed on the preform, a step for removing the flashes is required; i.e., the number of processing steps increases, and the yield of the preform is lowered.

The production method of the present invention is suitable for producing a member having a plurality of branches.

The expression "a member having a plurality of branches" as used herein refers to a member having a plurality of branches (for example, when the member is used in combination with a separate-type member, each branch serves as a portion to be joined with or supported by the separate-type member) in which each of the branches extends from its tip end through an arbitrary path toward the confluence (e.g., center of gravity) which falls within a polygon formed by connecting the ends of the branches, the branches having no side branches. This definition encompasses the case where the confluence of the branches is the end of a certain branch.

In order to reduce the weight of the member, holes may be formed in the branches through punching. The member may also be seen as a member having a plurality of branches extending from the confluence of the branches. The present invention can be applied to a member having extending branches that are symmetrical or asymmetrical with respect to the confluence of the branches.

Another example of the member having a plurality of branches is a metal forged product shown in FIG. 26, which is produced from a preform shown in FIG. 25 formed by a preliminary forging step, which preform is then subjected to a plurality of intermediate forging steps and a final forging step. Still another example is a metal forged product shown in FIG. 28, which is produced from a preform shown in FIG. 27 formed by a preliminary forging step, which preform is then subjected to a plurality of intermediate forging steps and a final forging step.

The metal forged product manufactured by the production method of the present invention has a complicated shape, as compared with conventional forged products, resulting in attainment of enhanced mechanical strength. The production method of the present invention enables the amount of the material used to produce a product to be reduced and makes it possible to produce a lightweight product.

Examples of the member having a plurality of branches include an upper arm and a lower arm, which are suspension parts for vehicles. For such parts, improvement of the mechanical strength of branches thereof is required.

Further examples of the member having a plurality of branches include a carrier and a strut knuckle, which are suspension parts for vehicles produced by conventional metal forging methods.

In the preliminary forging step of the production method of the present invention, a preform is formed through closed forging from a cylindrical material having a surface layer on a circumferential surface thereof, such that the surface layer is contained in a surface region of the preform. The surface region preferably has a thickness of 7 mm or less (more preferably 5 mm or less, much more preferably 3 mm or less) as measured from the surface of the preform.

Through the preliminary forging step, a portion that may cause lowering of the quality of a forged product is accumulated in the surface region. As a result, the portion can be readily prevented from being contained in a target forged-product obtained through the intermediate forging step described below.

Conventionally, in order to prevent generation of an undercut during the course of formation of a preform, a forging die has been designed in consideration of the shape of the preform, the shape of the cavity of the die and the direction in which load is applied by means of a punch.

In the present invention, the shape of a preform is designed such that, in the below-described intermediate forging step, the surface layer of the forging material is completely extruded and the volume of the preform becomes small. A limitation is imposed on the relation between the thickness of the forging material and that of the preform. In the preliminary forging step, the forging material is placed in a forging die such that the upper and lower surfaces of the forging material correspond to parallel surfaces of the perform and that pressure is applied by means of a punch (upper die block) of the forging die onto the circumferential surface of the forging material, which circumferential surface has the surface layer. The relation between the positions of portions of the cavity corresponding to the respective branches of the preform and the load application direction of the punch are determined such that metal flow by means of load application occurs along the branches of the perform. As a result, the preform is formed such that the surface layer is contained in the surface region of the preform.

Figure 3:
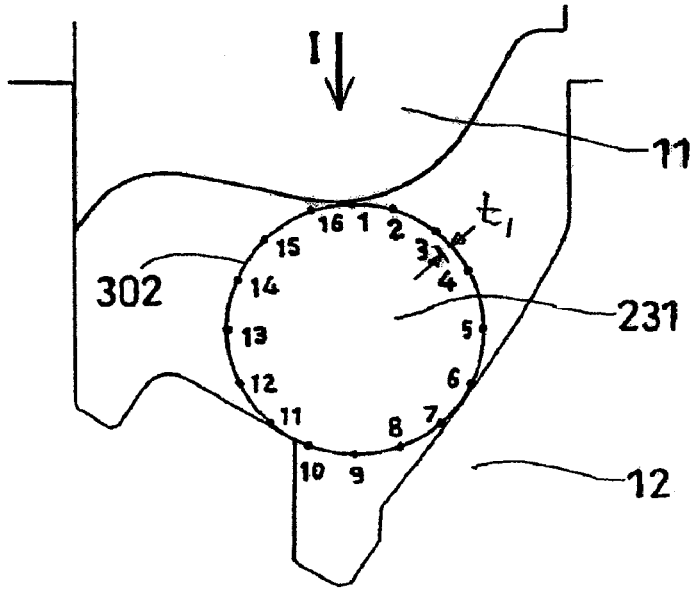
FIG. 3 is an explanatory view showing the preliminary forging step of the production method of the present invention, FIG. 3(*a*) showing the state where a forging material is placed, FIG. 3(*b*) showing the state where pressure is being applied to the forging material, and FIG. 3(*c*) showing the state where forging is completed.
Figure 3:
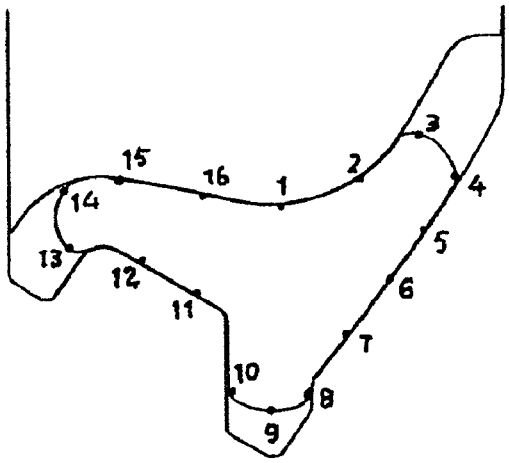
Figure 3:
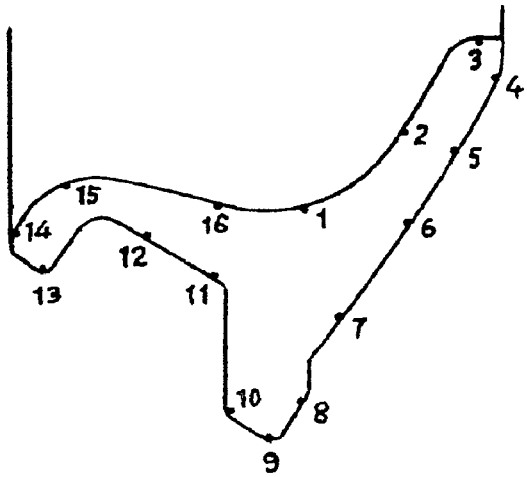

FIG. 3 shows the cavity of a forging die, the direction in which load is applied by means of a punch, the shape of a preform during the forging process and the state of a surface layer during the forging process. FIG. 3(*a*) shows the shape of the cavity of the die and the directions of branch-corresponding portions of the cavity, the position of a forging material 231 and the direction I in which load is applied by means of the punch. Dots with numerals provided at the periphery of the forging material 231 indicate corresponding points on a surface layer 302 having a thickness $t_1$. FIG. 3(*b*) shows change in the shape of the preform during pressure application and change in the positions of the points on the surface layer during the forging process, these changes being simulated by use of plastic working simulation software (DEFORM, product of SFTC (US)). As shown in FIG. 3(*b*), plastic flow of the forging material occurs along the branches of the preform, and the surface layer does not enter the interior of the preform. FIG. 3(*c*) shows the shape of the preform and the state of the surface layer after completion of forging. Conceivably, plastic flow of the forging material occurs along the branches, and the surface layer remains on the periphery of the preform and does not enter the interior of the preform.

In order to form a preform as described above, in the preliminary forging step of the production method of the present invention, preferably, there is employed, as a forging material, a cylindrical cast ingot which assumes a shape having an upper surface and a lower surface each containing no angular portion and a circumferential surface and such that the ratio of the lateral length of a projection profile of the ingot, which profile is formed in a direction perpendicular to the direction of pressure application, to the length of the ingot as measured in the direction of pressure application is 1 or less; and pressure is applied onto the circumferential surface of the cylindrical forging material.

The expression "a cylinder having an upper surface and a lower surface each containing no angular portion and a circumferential surface" refers to, for example, a cylindrical object having opposing surfaces, each of which is defined by a curve containing no angular portion; a truncated-cone-shaped object having opposing surfaces, each of which is defined by a curve containing no angular portion; a cylindroid; and a truncated elliptical cone.

When the ratio of the lateral length of a projection profile of a forging material, which profile is formed in a direction perpendicular to the direction of pressure application, to the length of the forging material as measured in the direction of pressure application exceeds 1, the projection area of the forging material as viewed in the direction of pressure application becomes large, requiring a high forging load, which may tend to be excessively great to thereby prevent reliable forging of a preform. Such an increase in forging load adversely affects forging of a preform of an upper arm or a lower arm, which is a suspension part for a vehicle. Furthermore, an expensive forging machine capable of applying high load is required for forging, resulting in high production cost.

In the preliminary forging step of the production method of the present invention, since pressure is applied onto the circumferential surface of a forging material as described above, plastic flow of the material starts at a portion of small projection area to proceed in the elongate direction, resulting in enhancement of the strength of that portion. When a preform is a member having a plurality of branches, stratiform metal flow occurs along the contour of the branches, resulting in enhancement of the strength of the branches.

When the forging material is a round piece obtained through cutting of a round bar material, during the course of forging, preferably, pressure is applied not onto a cut surface of the piece, but onto the surface perpendicular to the cut surface of the piece. That is, pressure is applied onto the circumferential surface of the piece. When pressure is applied onto the circumferential surface of the piece, the upper and lower surfaces of the piece correspond to parallel surfaces of the resultant preform.

The expression "parallel surfaces of a preform" as used herein refers to opposing surfaces of the preform that are substantially parallel to each other, each of the surfaces having a large area.

In the conventional forging method applying pressure onto the cut surface of a cut piece obtained from a round bar material, during production of a preform having branches through plastic flow of the piece (forging material), which preform is a suspension part for a vehicle, an edge at which the cut surface meets the outer peripheral surface (circumferential surface) of the piece becomes a branch of a forged product (preform). In this case, since the rate and the direction of plastic flow of the forging material differ from portion to portion in the cut surface and the outer peripheral surface of the material, forging defects attributed to the aforementioned edge, such as overlap, are generated on the surface of the branch of the preform. As a result, the preform may be broken at a portion at which the forging defects are generated, making the preform unusable as a preform for a high-quality forged product.

In contrast, in the preliminary forging step of the production method of the present invention, a cylindrical cast ingot containing no angular portion is employed as a forging material, and pressure is applied onto the circumferential surface of the cylindrical forging material. Therefore, since plastic flow of the material occurs such that the aforementioned edge falls on the peripheral outline of a forged product, generation of forging defects, such as overlap, in the branches of the forged product can be prevented. Furthermore, since the ratio of the lateral length of a projection profile of the forging material, which profile is formed in a direction perpendicular to the direction of pressure application, to the length of the material as measured in the direction of pressure application is 1 or less, the projection area of the forging material as viewed in the direction of pressure application becomes small, and forging load to be applied can be reduced.

When pressure is applied onto the outer peripheral surface (i.e., the surface perpendicular to the cut surface) of a cut piece obtained from a round bar material and serving as a cylindrical forging material, since plastic flow of the material occurs such that the aforementioned edge falls on the peripheral outline of a forged product, generation of forging defects, such as overlap, in the branches of the forged product can be prevented, which is preferable. Furthermore, since the ratio of thickness of the cut piece to the diameter of the cut piece is 1 or less, the projection area of the cut piece (forging material) as viewed in the direction of pressure application becomes small, and forging load to be applied can be reduced, which is preferable.

In the preliminary forging step of the production method of the present invention, the outline of the upper and/or lower surface of a forging material preferably contains no angular portion and assumes a smooth shape. More preferably, the outline assumes a circular shape, an elliptical shape or a smoothly extending polygonal shape, since such shapes can prevent generation of forging defects, such as overlap.

From the viewpoints of cost and workability, the forging material employed in the present invention is preferably a cylindrical cut piece obtained by cutting a round bar material such that the ratio T/R of the thickness (T mm) of the piece to the diameter (R mm) of the piece is 1 or less (preferably ($\pi/4$) or less, more preferably 0.5 or less).

In the production method of the present invention, the forging material may be a metallic material. Examples of the metallic material include aluminum, iron, magnesium and an alloy predominantly containing such a metal. Examples of the aluminum alloy include an Al—Mg—Si alloy, an Al—Cu alloy and an Al—Si alloy. Examples of the Al—Mg—Si alloy include JIS 6061 alloy and SU 610 alloy.

Examples of the Al—Cu alloy include JIS 2024 alloy and JIS 2014 alloy. Examples of the Al—Si alloy include JIS 4032 alloy.

The forging material employed in the present invention may be produced by means of any customary method, such as continuous casting, extrusion or rolling. A continuously cast round bar material of aluminum or aluminum alloy is preferred, in view of low cost. A round bar material of aluminum alloy (e.g., SHOTIC (registered trademark): product of Showa Denko K.K.) which is continuously cast by means of an air-pressurized hot top casting process is more preferred, since the material exhibits excellent soundness and has fine crystal grains and since the grains exhibit no anisotropy attributed to plastic working. The reason for the above is as follows. In the forging method of the present invention, when the round bar material of aluminum alloy (i.e., a forging material) is employed, stratiform plastic flow of the material occurs uniformly in branches of a preform, resulting in generation of no forging defects, such as underfill, and enhancement of the mechanical strength of the preform.

In the production method of the present invention, preferably, the volume (V $mm^3$) of a preform, the thickness (T mm) of the round bar material, the longitudinal length (L mm) of a projection profile of the preform as viewed in the direction of pressure application and the diameter (R mm) of the round bar material satisfy the following relation:

$$(1/3)\times L \leqq R = 2\times(V/T\pi)^{1/2} \leqq L.$$

In the case where the diameter (R) of a cut piece obtained from the round bar material is expressed by $R=2\times(V/T\pi)^{1/2}<(1/3)L$, since a forging load higher than the maximum load obtained from a press must be applied to the cut piece (i.e., the forging material) so as to cause plastic flow of the material in branches of a preform through a single forging step, a plurality of forging steps are required. In addition, as a result of insufficient application of load, underfill may arise in the preform, resulting in failure of production of an intended preform. In this case, the distance of plastic flow of the forging material becomes long, and a lubrication film provided between the forging material and a forging die is broken, resulting in generation of forging defects, such as sticking and galling, on the preform. Therefore, mechanical processing may be required for removing the forging defects. Meanwhile, in the case where the longitudinal length (L) is smaller than the diameter (R); i.e., the relation between L and R is $L<R=2\times(V/T\pi)^{1/2}$, since the cut piece cannot be placed in the forging die, closed forging cannot be performed.

Regarding the round bar material (i.e., the forging material) employed in the present invention, preferably, the thickness (T mm) of the round bar material is (0.8 to 1.0)×(the lateral length (t mm) of a projection profile of a preform as viewed in the direction of pressure application). When the thickness of a cut piece obtained from the round bar material is 0.8×t or more, the forging material is not inclined in a forging die, and the material placed in the die is stabilized in the die. Therefore, forging defects, such as underfill, thickness deviation and overlap, do not arise during forging, resulting in production of a forged product of high quality. However, when the thickness of the cut piece exceeds 1.0×t, since the forging material cannot be placed in the forging die, closed forging without formation of flashes cannot be performed.

In the intermediate forging step of the production method of the present invention, the surface layer of the preform obtained through the preliminary forging step, which surface layer is contained in the surface region of the perform, is extruded in the form of flash outside a product-shape-determining section of a forging die. In accordance with the shape of a target product and the extrusion conditions of the surface layer, the intermediate forging may be performed in a single step or in a plurality of steps.

Now will be described the process of the intermediate forging step in which the surface layer contained in the surface region of a preform is extruded in the form of flash with reference to FIGS. 15 and 4.

Figure 14:
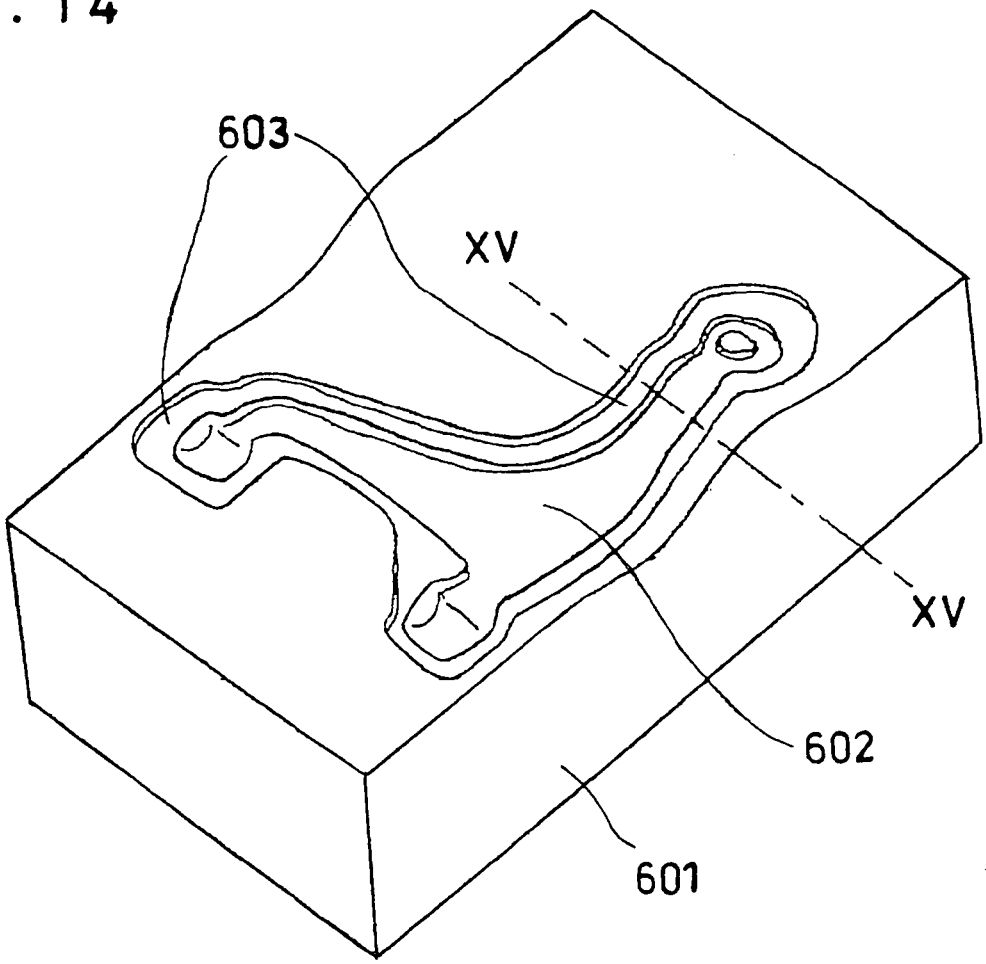
FIG. 14 is a schematic representation showing an embodiment of the die of the present invention for the intermediate forging step.
Figure 15:
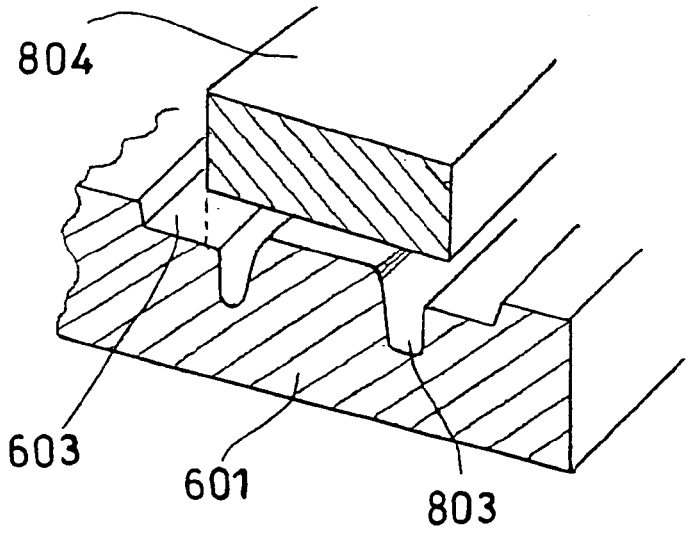
FIG. 15 is an explanatory view showing the position of a preform that is placed on the die for the intermediate forging step of the production method of the present invention.

FIG. 15 shows the state where the preform is placed on a lower die block 601 of the forging die for the intermediate forging step such that the surface layer of the preform is to be extruded. FIG. 15 is a schematic cross-sectional view of the lower die block shown in FIG. 14, as taken along line XV-XV. Since a portion of the preform 804 shown in FIG. 15 has a thickness smaller than that of the corresponding portion of a forged product, the preform is placed on the lower die block such that the surface region of the preform is located above a surface-layer-extruding section 603 provided outside a product-shape-determining section 602 (FIG. 14) of the cavity of the lower die block.

Figure 4:
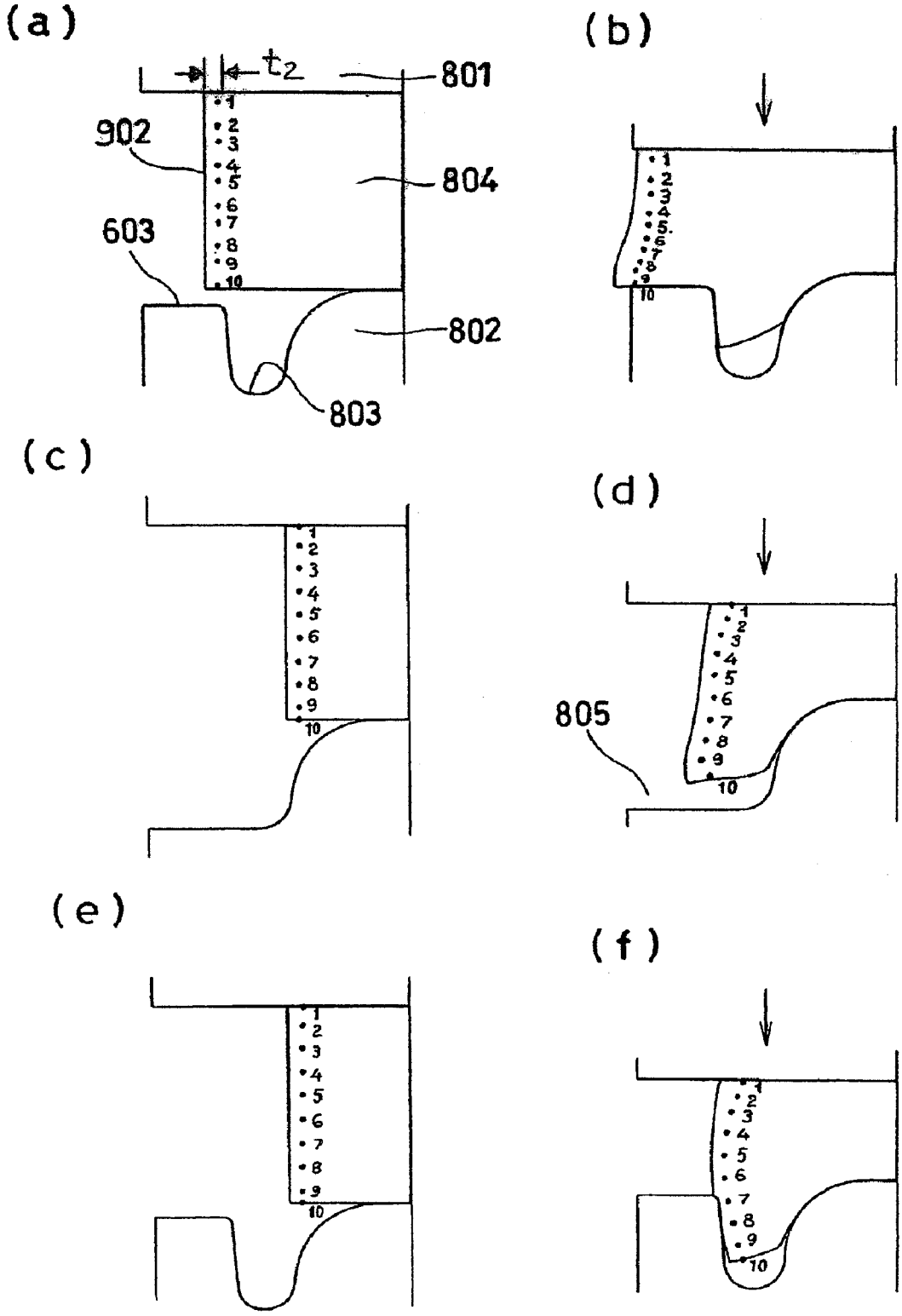
FIG. 4 is an explanatory view showing the intermediate forging step of the production method of the present invention, FIG. 4(*a*) showing an example of arrangement of the preform and die, FIG. 4(*b*) showing the state of underway forging after start of pressure application, FIG. 4(*c*) showing another example of arrangement of the preform and die, FIG. 4(*d*) showing the state of underway forging after start of pressure application, FIG. 4(*e*) showing another example of arrangement of the preform and die and FIG. 4(*f*) showing the state of underway forging after start of pressure application.

FIG. 4 shows the process in which the surface layer contained in the surface region of the preform is extruded in the form of flash and which is simulated by use of plastic working simulation software (DEFORM, product of SFTC (US)). FIG. 4(*a*) shows an example of arrangement of the preform and the forging die. FIG. 4(*a*) is a cross-sectional view showing the state where the preform 804 is placed between an upper die block (punch) 801 of the forging die for the intermediate forging step and a lower die block 802 of the forging die for the intermediate forging step. The cross-sectional view shows the inside and outside of the product-shape-determining section. Reference numeral 803 denotes the periphery of the product-shape-determining section of the cavity. A surface region 902 of the preform, the region containing the surface layer of the forging material, and having a thickness $t_2$ is located outside the product-shape-determining section of the cavity. Specifically, the surface region of the preform is located above the surface-layer-extruding section 603 provided outside the product-shape-determining section of the cavity of the lower die block. Dots with numerals indicate corresponding points in the surface region of the preform. FIG. 4(*b*) shows the state where the preform is being forged under application of pressure. As shown in FIG. 4(*b*), the surface region of the preform, the region containing the surface layer of the forging material, is extruded by means of the surface-layer-extruding section 603.

FIG. 4(*e*) shows the state where the surface region of the preform, the region containing the surface layer of the forging material, is located inside the product-shape-determining section of the cavity. As shown in FIG. 4(*f*), a portion of the surface region of the preform, the region containing the surface layer of the forging material, enters the product-shape-determining section of the cavity.

As shown in FIGS. 4(*c*) and 4(*d*), the surface layer can be extruded by means of a surface-layer-extruding section 805 that is provided outside the product-shape-determining section of the cavity such that the level of the section 805 is equal to or lower than that of the product-shape-determining section. FIG. 4(*c*) shows the state where a portion of the perform, which portion has a thickness greater than that of the corresponding portion of a forged product, is placed between the upper and lower die blocks such that the surface region of the preform is located inward from the product-shape-determining-section-side end of a portion of the cavity of the lower die block, which portion is provided outside the product-shape-determining section and has a level equal to or lower than that of the product-shape-determining section. FIG. 4(*d*) shows the state where the preform is being forged under application of pressure. As shown in FIG. 4(*d*), the surface region of the preform, which region contains the surface layer of the forging material, is extruded by means of the surface-layer-extruding section 805.

As described above, when the product-shape-determining section of the cavity of the forging die for the intermediate forging step and a portion outside the product-shape-determining section are disposed in accordance with the nature of the surface region of the perform. Conceivably, the surface layer contained in the surface region of the preform can be extruded in the form of flash outside the product-shape-determining section.

Figure 6:
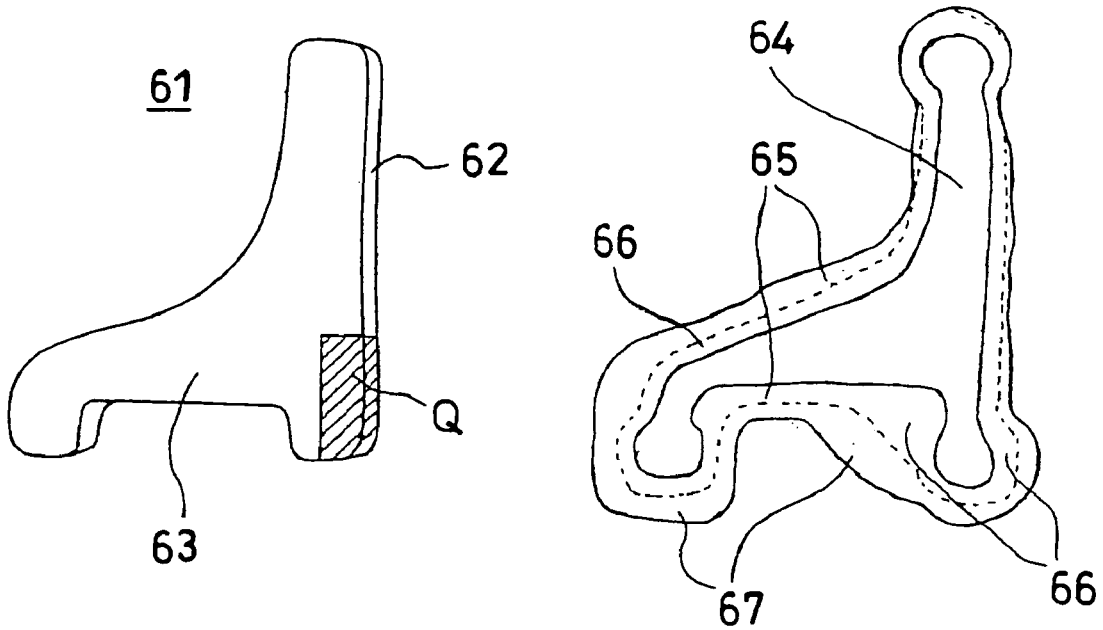
FIG. 6 shows the appearance of a forged product that is to be formed into an upper arm according to an embodiment of the present invention, FIG. 6(*a*) showing the appearance of a forging preform produced through the preliminary forging step and FIG. 6(*b*) showing the appearance of a forged product produced through the intermediate forging step.

FIG. 6(*b*) shows an example of a forged product with the surface layer being extruded in the form of flash. A portion 66, which has been formed through extrusion of the surface layer, is provided at the periphery of a product-corresponding region 64 that has been formed through forging by means of the product-shape-determining section of the cavity. The surface layer is extruded in the vicinity of a surface layer relief line 65 shown by a broken line. A flash portion 67, which is derived from a portion of the preform other than the surface layer, is extruded outside the line 65.

The forged product obtained through the intermediate forging step, which has a target product shape, is subjected to the flash removal step to thereby remove the flash containing the surface layer and produce a target forged product.

Furthermore, a forged product having the surface layer extruded in the form of flash outside the product-corresponding region may be subjected to a final forging step. This is preferred because a final product can be forged in a more complicated shape.

The preliminary forging step to obtain a preform may be performed a plurality of times. This enables the shape of a forged product to comply with a more complicated shape.

As described above, a characteristic feature of the production method of the present invention resides in that the method includes the preliminary forging step of forming a preform through closed forging from a cylindrical material having a surface layer on a circumferential surface thereof, such that the surface layer is contained in a surface region of the perform, and the intermediate forging step of subjecting the preform to forging to thereby extrude the surface layer, which is contained in the surface region, in the form of flash outside the periphery of a target-product-corresponding portion of a forged product. In the conventional product method, a surface layer is removed from a forging material for forming a preform, and a flash is removed from the resultant preform, to thereby produce a target product. Therefore, in the conventional method, as a result of removal of the surface layer and the flash, the yield of the target product on the basis of the forging material is lowered. In contrast, in the production method of the present invention, a step of removing a surface layer from a forging material for forming a preform can be omitted, and therefore, lowering of the yield of a forged product on the basis of the forging material, which is caused by removal of the surface layer, can be prevented, and productivity is enhanced.

According to the production method of the present invention, a forged product of an upper arm or a lower arm, which is a suspension part for a vehicle, can be produced by applying pressure onto the circumferential surface of a cylindrical forging material, which circumferential surface has a surface layer. In addition, the number of processing steps can be reduced, load to be applied during forging can be reduced, and the yield of a target product on the basis of the forging material is high.

In the preliminary forging step (closed forging step) of the production method of the present invention, preferably, there is employed, as a forging material, a cylindrical cast ingot which has the same volume as a preform, which assumes a shape having an upper surface and a lower surface each containing no angular portion and a circumferential surface, and such that the ratio of the lateral length of a projection profile of the ingot, which profile is formed in a direction perpendicular to the direction of pressure application, to the length of the ingot as measured in the direction of pressure application is 1 or less; the cylindrical forging material is disposed in a posture such that the upper and lower surfaces correspond to parallel surfaces of the preform; and pressure is applied onto the circumferential surface of the cylindrical forging material. Therefore, load to be applied during forging can be reduced, the yield of a forged product on the basis of the forging material is high, and the mechanical strength of the forged product can be enhanced.

According to the preliminary forging step of the production method of the present invention, a forging preform of an upper arm or a lower arm, which is a suspension part for a vehicle, can be produced by applying pressure onto the circumferential surface of a cylindrical forging material, which circumferential surface has a surface layer. In addition, load to be applied during forging can be reduced, and the yield of a forged product on the basis of the forging material is high.

The surface layer of the forging material is accumulated in the surface region of the forging preform obtained through the preliminary forging step of the production method of the present invention. Therefore, when the preform is subjected to the intermediate forging step of the production method of the present invention, there is produced a forged product in which the surface layer is extruded in the form of flash outside the periphery of a target-product-corresponding portion of the forged product. In the production method of the present invention, a forging material having a surface layer can be subjected to forging without any preliminary treatment of the material to thereby yield a forging preform, and thus a step of removing the surface layer is omitted. In addition, lowering of the yield of the forging preform on the basis of the forging material, which is caused by removal of the surface layer, can be prevented, and therefore productivity is enhanced.

In the forging preform produced through the preliminary forging step of the production method of the present invention, plastic flow of the forging material occurs along a plurality of branches of the preform. Therefore, when the preform is subjected to the intermediate forging step and then to the final forging step to thereby produce a forged product, at a center portion of the cross section of a branch of the forged product, stratiform metal flow occurs along the contour of the product. As a result, the mechanical strength of the forged product is enhanced. The forging preform is suitable for use as a forging preform of an upper arm or a lower arm, which is a suspension part for a vehicle.

The term "metal flow" as used herein refers to flow of crystal grains of a forged product produced through forging which is a form of plastic working. The expression "stratiform metal flow occurs" refers to the state where crystal grains flow uniformly along the contour of a forged product. That is, metal flows in layers along the contour of a forged product. In the cross section of the forged product, the layers observed are along the shape of the forged product and do not end at the contour of the shape (surface) of the product, or disturbance of the layers is not observed in the product. In other words, the forged product has metal flow along each branch thereof.

In the case where an aluminum alloy, such as JIS 2014 alloy or JIS 6061 alloy, is forged into a product, when the amount of plastic flow is larger, the mechanical strength of the forged product is more enhanced. However, when the amount of plastic flow is excessively large, crystal grains become large at a portion of the forged product, which leads to considerable reduction in the mechanical strength of the forged product. When a forged product is produced through the conventional forging method with flashes being formed, the amount of plastic flow becomes large in the vicinity of a parting line of the forged product. Therefore, crystal grains become large in the vicinity of the parting line of the forged product obtained through the conventional method, and thus the mechanical strength of the product is lowered.

In contrast, when a forged product is produced through the preliminary forging step of the production method of the present invention, no flash is formed on the forged product, and thus no parting line is present on the product. Therefore, the method of the present invention is more advantageous than the conventional method in that crystal grains can be prevented from becoming large and in that partial reduction in the strength of the forged product can be prevented. The thus forged product is suitable for use as a forging preform of an upper arm or a lower arm, which is a suspension part for a vehicle.

As described above, when a forging preform is produced through the preliminary forging step of the product method of the present invention, no flash is formed on the preform, and thus the preform has no flash removal mark. Production of a forging preform through the forging step is preferred from the viewpoint of enhancement of the yield of the preform. The thus produced preform is suitable for use as a forging preform of an upper arm or a lower arm, which is a suspension part for a vehicle.

Next will be described the metal forged product production system employed in the production method of the present invention.

Figure 10:
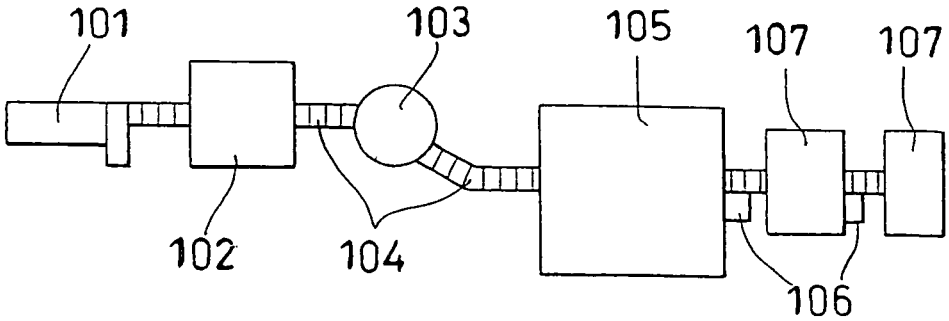
FIG. 10 is a schematic representation showing a metal forged product production system according to an embodiment of the present invention.

FIG. 10 schematically shows an example of the metal forged product production system employed in the above-described production method.

As shown in FIG. 10, the metal forged product production system includes a material cutting apparatus 101 and a forging apparatus 105. In the case of hot forging in which a forging material is subjected to forging after the material is heated, the production system must include a material-heating apparatus 103. When a material feeding apparatus 102, a material conveying apparatus 104 and a forged-product-conveying apparatus 106 are provided in the production system, a completely automatic production system is attained. When a forged product assumes the shape of a target product, a forged product heat treatment furnace 107 is preferably provided in the production system.

The material cutting apparatus 101 is provided for cutting a continuously cast round bar into pieces having the same volume as a preform. The material feeding apparatus 102 is provided for storing a predetermined amount of a forging material in a hopper and then feeding the material to the subsequent apparatus. The material conveying apparatus 104 is provided for conveying the forging material to a die. The forging apparatus 105 is provided for subjecting the forging material to forging.

The forging apparatus 105 includes a forging machine including a closed-forging die (die A) employed for the preliminary forging step, a forging machine including a forging die (die B) employed for the intermediate forging step and a forging machine having a die (die C) employed for the final forging step, which machines are connected in series. The forging die A includes a punch and die blocks and has a cavity including a forging space which is designed such that there can be produced therein a preform having a surface layer in its surface region and no flash removal mark on the surface region, having a plurality of branches and having metal flow in a longitudinal direction of the branches. The forging die B includes a punch and die blocks, and having a cavity including a forging space which is designed such that the surface layer of the preform, which surface layer is contained in the surface region thereof, can be extruded in the form of flash outside a product-shape-determining section of the cavity. The forging apparatus 105 may be a single forging apparatus including the dies A, B and C, which are operated in the corresponding forging steps.

A flash removing apparatus is provided for removing the flash containing the surface layer. The flash removing apparatus may be a conventionally known one.

The forged-product-conveying apparatus 106 is provided for discharging a forged product from a die by means of a knock-out mechanism and then conveying the forged product to downstream apparatus. The apparatus 106 is also employed in the case where a forged product is removed from separate die blocks and then conveyed to downstream apparatus. The material heating apparatus 103 is provided for heating the forging material to thereby enhance forgeability thereof. The forged product heat treatment furnace 107 is provided for subjecting the resultant forged product to heat treatment that includes solid solution treatment and aging treatment.

Figure 11:
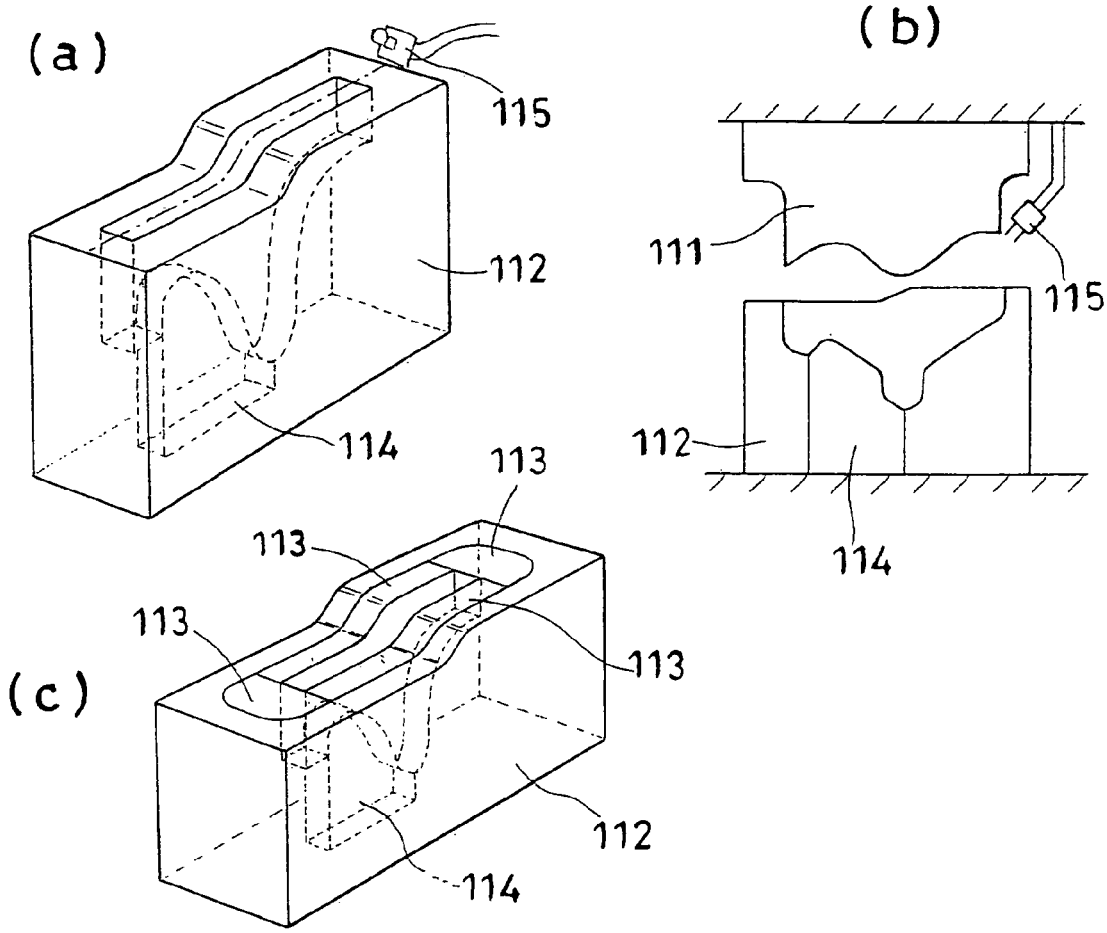
FIG. 11 is a schematic representation showing the structure of a forging die for the preliminary forging step according to an embodiment of the present invention, FIG. 11(*a*) showing an example of a unit die, FIG. 11(*b*) being a cross-sectional view of the die shown in FIG. 11(*a*), and FIG. 11(*c*) showing an example of a separate-type die.

The configuration of the forging die (die A) of the present invention for the preliminary forging step, which is incorporated in the forging machine, will be roughly described with reference to FIG. 11.

The forging die of the present invention for the preliminary forging step includes a punch 111 and die blocks 112. The forging die may include bushes 113 and a knock-out 114 in accordance with the shape of a forged product to be produced. If desired, for example, in the case of hot forging in which a forging material is subjected to forging after the material is heated, a lubricant spraying apparatus 115 for spraying a lubricant to the die is preferably provided on the forging die or in the forging machine. The lubricant spraying apparatus 115 may be provided separately from the forging machine, and operation of the apparatus may be linked with that of the forging machine.

The forging die of the present invention for the preliminary forging step includes a punch and die blocks and has a cavity including a forging space which is designed such that there can be produced therein a preform having a surface layer in its surface region and no flash removal mark on the surface region, having a plurality of branches and having metal flow in a longitudinal direction of the branches. Preferably, the forging die has a horizontally separable structure and includes means for uniting and holding separate die blocks.

Preferably, the forging die of the present invention for the preliminary forging step is designed such that the cylindrical cast ingot serving as a forging material can be placed in a space defined by the punch and the die blocks and such that pressure is applied onto the circumferential surface of the cylindrical cast ingot. The cylindrical cast ingot has the same volume as a perform and assumes a shape having an upper surface and a lower surface each containing no angular portion and a circumferential surface and such that the ratio of the lateral length of a projection profile of the ingot, which profile is formed in a direction perpendicular to the direction of pressure application, to the length of the ingot as measured in the direction of pressure application is 1 or less.

Preferably, the forging die of the present invention for the preliminary forging step is designed such that a member having a plurality of branches is produced through closed forging, such that the cylindrical piece serving as a forging material can be placed in a space defined by the punch and the die blocks, and such that pressure is applied onto the circumferential surface of the cylindrical piece. The cylindrical piece is obtained by cutting a round bar material such that the ratio T/R of the thickness (T mm) of the piece to the diameter (R mm) of the piece is 1 or less, and the piece has the same volume (V $mm^3$) as a preform.

From the viewpoint of metal flow, particularly preferably, the forging die is designed such that the cylindrical piece can be placed in the aforementioned space so as to be in contact with the vicinity of the confluence of branch-corresponding portions of the space.

Preferably, the forging die of the present invention for the preliminary forging step has a space defined by the punch and the die blocks such that the volume (V $mm^3$) of a preform, the thickness (T mm) of a round bar material, the longitudinal length (L mm) of a projection profile of the preform as viewed in the direction of pressure application and the diameter (R mm) of the round bar material satisfy the relation $(1/3)\times L \leqq R = 2\times(V/T\pi)^{1/2} \leqq L$.

Preferably, the forging die of the present invention for the preliminary forging step has a space defined by the punch and the die blocks such that the thickness (T mm) of a round bar material is (0.8 to 1.0)×(the lateral length (t mm) of a projection profile of a preform as viewed in the direction of pressure application).

The forging die of the present invention for the preliminary forging step has a cavity including a forging space which is designed such that there can be produced therein a preform having a surface layer in its surface region and no flash removal mark on the surface region, having a plurality of branches and having metal flow in a longitudinal direction of the branches. Therefore, by use of the forging die, a preform can be readily formed from a cylindrical material having a surface layer on a circumferential surface thereof, such that the surface layer is contained in a surface region of the preform. Thus, when the forging die is employed, the cylindrical material having a surface layer which may cause lowering of the quality of a forged product can be subjected to forging without any preliminary treatment of the material, and thus a step of removing the surface layer is omitted. In addition, lowering of the yield of the preform on the basis of the forging material, which is caused by removal of the surface layer, can be prevented, and therefore productivity is enhanced.

Preferably, the forging die of the present invention for the preliminary forging step is designed such that the cylindrical cast ingot serving as a forging material can be placed in a space defined by the punch and the die blocks and such that pressure is applied onto the circumferential surface of the cylindrical cast ingot. The cylindrical cast ingot has the same volume as a perform and assumes a shape having an upper surface and a lower surface each containing no angular portion and a circumferential surface and such that the ratio of the lateral length of a projection profile of the ingot, which profile is formed in a direction perpendicular to the direction of pressure application, to the length of the ingot as measured in the direction of pressure application is 1 or less. Therefore, load to be applied during forging can be reduced, the yield of a preform on the basis of the forging material is high, and the mechanical strength of the preform can be enhanced.

The forging die (die B) of the present invention for the intermediate forging step includes a punch and die blocks and has a cavity including a forging space which is designed such that the surface layer of the preform, which surface layer is contained in the surface region thereof, can be extruded in the form of flash outside a product-shape-determining section of the cavity.

FIG. 14 schematically shows an example of a lower die block of the forging die employed in the intermediate forging step. A surface-layer-extruding section 603 for removing the surface region is provided at the periphery of a product-shape-determining section 602 of the cavity of the die block. In addition, a dent whose shape corresponds to the shape of a preform is provided in the die block.

The cavity of the die block is designed such that, in a cavity region in which a portion of the perform, which portion has a thickness smaller than that of the corresponding portion of a forged product, is subjected to forging, the surface region of the preform is located above the surface-layer-extruding section provided outside the product-shape-determining section of the cavity of the lower die block. Also, the cavity of the die block is designed such that, in a cavity region in which a portion of the perform, which portion has a thickness greater than that of the corresponding portion of a forged product, is subjected to forging, the surface region of the preform is located inward from the product-shape-determining-section-side end of a portion of the cavity of the lower die block, which portion is provided outside the product-shape-determining section. The surface-layer-extruding section is designed such that the level of the periphery of the cavity of the die block becomes equal to or lower than that of the product-shape-determining section.

Therefore, the thickness of a parting line (flash-corresponding line) formed at the periphery of the resultant forged product differs from portion to portion.

FIG. 15 shows the state where the preform is placed on the lower die block such that the surface region of the preform is located outside the product-shape-determining section of the cavity of the die block. FIG. 15 is a schematic cross-sectional view of the lower die block shown in FIG. 14, as taken along line XV-XV.

The cavity of the lower die block is designed so as to meet the aforementioned requirements. For example, when the thickness of a portion of a forged product is greater than the thickness of a preform, the width of the cavity is designed to become smaller than that of the preform. This is because, since the volume of the corresponding portion of the forged product is greater than that of the preform, a peripheral portion of the preform is accumulated in the cavity. Meanwhile, when the thickness of a portion of a forged product is smaller than the thickness of a preform, the preform is placed on the die block such that the surface region of the preform is located inward from the product-shape-determining-section-side end of a portion of the cavity of the lower die block, which portion is provided outside the product-shape-determining section and has a level lower than that of the product-shape-determining section. Since the volume of the corresponding portion of the forged product is smaller than that of the preform, the surface region of the preform can be extruded outside the cavity of the die block by means of a protrusion of the die block.

The operation of the forging die for the intermediate forging step has been described with reference to the lower die block. Similar to the case of the lower die block, a cavity can be provided in the upper die block such that the die block attains the aforementioned operation. Alternatively, the upper and lower die blocks are combined together so as to attain the aforementioned operation.

The forging die of the present invention for the intermediate forging step includes a punch and die blocks, and has a cavity including a forging space which is designed such that the surface layer of the preform, which surface layer is contained in the surface region thereof, can be extruded in the form of flash outside a product-shape-determining section of the cavity. Therefore, by use of the forging die, a forged product can be readily produced from the preform having the surface layer in its surface region such that the surface layer is extruded in the form of flash outside the periphery of a target-product-corresponding portion of the forged product. Thus, when the forging die is employed, the forged product having the extruded surface layer in the form of flash can be readily produced from the forging preform, which has been produced through forging of the forging material having the surface layer without any treatment of the material. Therefore, a step of removing the surface layer is omitted, and lowering of the yield of the forged product on the basis of the forging material, which is caused by removal of the surface layer, can be prevented, leading to enhancement of productivity.

Now, an example of how to design the shape of a forged product, the shape of a preform and the relation between the position of the surface region of the preform and the position of the cavity of a die for the intermediate forging step will be described.

(a) Supposing a rectangle having a lateral width of (the lateral width of a given forged product)+(the surface layer of the product×2 or more)=20 mm or more, for example, the height of the rectangle is obtained so that the area of the rectangle equals the sectional area of the product.

(b) In accordance with (a) above, the heights of rectangles of all portions of the product, the cross-sectional shapes and areas of which have been obtained, are obtained, and the maximum height of the heights obtained is regarded as temporary fundamental height of a preform.

(c) Based on the height of the preform obtained in (b) above and (the lateral width of a given forged product)+(the surface layer of the product×2), the shape of the preform having initial values is assumed, where the lateral surface of the preform is regarded as a surface layer.

(d) The cross-sectional area of the shape of the preform having initial values is compared with that of the product shape at the sectioned position (FIG. 23(*a*)). The cross-sectional direction can be determined as a direction perpendicular to the direction in which the branches extend and parallel to the pressure application direction during the course of forging. Alternatively, it can be determined as a direction that is parallel to the pressure application direction during the course of forging and that is a direction having an angle at which the cross-sectional area is the minimum in the pressure application direction, or a direction perpendicular to the direction in which the branches extend and perpendicular to a parting line at the intermediate forging step. Otherwise, a cross-sectional area of the total of several sections having a larger volume (a ball joint section, a boss section and a bush attachment section, for example) of the product shape can be used as a representation of the cross-sectional area of the shape of the preform having initial values.

(e) As a result of (d) above, in the case where (the product shape cross-sectional area)<(the cross-sectional area of the preform shape having initial values), the preform is modified so that its width becomes small until preform shape cross-sectional area is equal to the product shape cross-sectional area and then subjected to (d) above. This is repeated (FIG. 23(*b*)).

(f) As a result of (e) above, when the preform width has been greater than the product width, the flash-extruding section of the die becomes the surface layer layer-extruding section (FIG. 23(*b*)). As a result of (e) above, when the preform width has been smaller than the product width, a surface layer-extruding section is provided in the die (FIGS. 23(*c*), 23(*d*) and 23(*e*)). A width 271 of the surface layer-extruding section provided when the preform width has been smaller than the product width is set to be preferably larger than that of the surface layer. While a depth 272 thereof is made wider simultaneously when the preform is pushed down in the die cavity during the course of forging (made much wider when the die has a protuberance), the surface layer of the lateral surface of the preform is spread at that time at the position of the extruding section and consequently extruded in the extruding section. Angled portions 273 of the extruding section are provided with curvature (radius of curvature: 3 to 10 mm, for example) so that extrusion of the surface layer is made smooth as well as the stress in the course of forging is relieved.

(g) The shape of the preform finally determined based on the above has a larger periphery than the product periphery when the volume of the preform is smaller than that required for the product or has a smaller periphery than the product periphery when the volume of the preform is greater than that required for the product (FIG. 24).

(h) As described above, the relation among the shape of the preform, the position of the surface layer, the cavity of the die for the intermediate forging step and the surface layer-extruding section of the die is as follows.

(1) At a portion of the die to be treated when the width of the preform has been greater than that of the product, the position of the surface layer of the preform is located on the periphery of the product formation cavity, and the surface layer extruding section is provided on that periphery so as to leave the surface layer.

(2) At a portion of the die to be treated when the width of the preform has been smaller than that of the product, the position of the surface layer is located inside the surface layer extruding section (inside the product), and the surface layer extruding section is provided so as to extrude the surface layer.

With the configuration described above, the extrusion of the surface layer in the present invention is not that by the closed forging. Therefore, the forging load can be reduced to a small level as compared with the closed forging, resulting in a long service life of the die, which is preferred. In addition, since the closed forging imposes restrictions on matched balance between a forging material and a forged product, the degree of design on the shape for extruding the surface layer is small (the position of the surface layer is required to be on the side of the periphery of the product formation cavity (outside a product corresponding portion), and it is difficult to make small the portion to be discharged, which includes the surface layer. In the present invention, however, since the die is of open type, the surface layer can be extruded in the form of a minimum addition volume and the portion to be discharged can be made small.

On the other hand, in the flash extrusion forging performed in an ordinary manner, the volume of a round bar material in the case where a product having a complicated shape is produced by forging is designed so that each part of the product can be forged with a small load into an intended volume and so that a good material yield can be attained. For this reason, since the material is designed to have a size falling inside the product formation cavity in order to reduce as much the material volume as possible, it is not designed to enable the surface layer to be extruded. Unlike in the ordinary flash extrusion forging, the preform is designed to have a shape based on the aforementioned idea and is disposed in the product formation cavity. As a consequence, it is possible to extrude a surface layer even when a preform having the surface layer is used without being subjected to any preliminary treatment.

The forging die (die C) for the final forging step is a conventionally known forging die including a punch and die blocks and having a cavity that includes a forging space designed to form a target product.

The forging die of the present invention employed in each of the forging steps may be formed of only one type of member selected from die blocks, a bush and a knock-out. For example, the forging die may be a unit-type die formed of die blocks only. Alternatively, the forging die may be formed of a combination of two or more types of the members. For example, the forging die may be a separate-type die formed of a plurality of bushes in combination with die blocks. From the viewpoint of improvement of the service life of the forging die, a separate-type die is more preferred.

Next will be described an embodiment of the production method of the present invention employing the metal forged product production system shown in FIG. 10, the die (A) shown in FIG. 11 and the die (B) shown in FIG. 14.

In accordance with the manufacture, the production method of the present invention may include:

1) a step of cutting a continuously cast round bar into pieces having the same volume as a preform;

2) a step of storing a predetermined amount of a forging material in a hopper and feeding the forging material to the subsequent step;

3) a step of conveying the forging material to a forging die;

4) steps of subjecting the forging material to forging (a preliminary forging step, an intermediate forging step and a final forging step) and removing (trimming) flash;

5) a step of discharging a forged product from the forging die; and 6) a heat treatment step for subjecting the resultant forged product to solid solution treatment and aging treatment.

In the case of cold forging in which a forging material is forged at ambient temperature to thereby produce a forged product having a simple shape, from the viewpoints of reduction of forging load and prevention of sticking between a forged product and a die, if desired, a bonde treatment step in which the forging material is subjected to chemical coating treatment is preferably carried out prior to the forging step.

In the case of hot forging in which a forging material is heated and then forged to thereby produce a forged product having a complicated shape, from the viewpoints of reduction of forging load and prevention of sticking between a forged product and a die, if desired, any one selected from the following steps is preferably carried out: a step of preliminarily heating a forging material, a step of subjecting a forging material to water-soluble graphite lubrication treatment prior to forging, a step of preliminarily heating a closed-forging die to a predetermined temperature, a step of spraying a water-soluble graphite lubricant onto a portion of a closed-forging die in which a forging material is forged and a step of spraying an oily lubricant onto a portion of a closed-forging die in which a forging material is forged.

Figure 12:
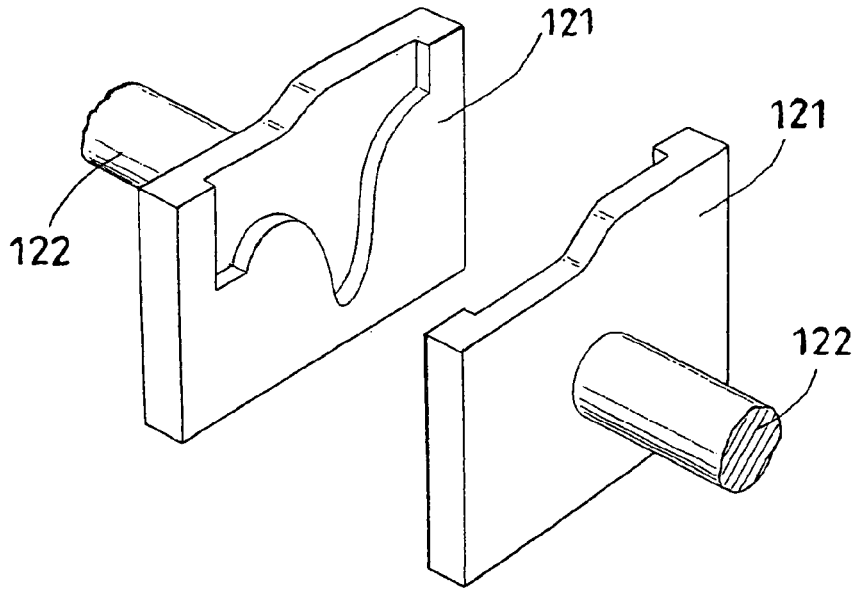
FIG. 12 is a schematic perspective representation showing another example of the separate-type die of the present invention, the die being employed in the preliminary forging step.

FIG. 12 schematically shows separate die blocks having a driving mechanism, which are one example of the die blocks included in the forging die employed in the preliminary forging step.

As shown in FIG. 12, a pair of die blocks 121 are disposed a predetermined distance away from each other such that surfaces of the die blocks, each of which surfaces has a preform-shape-determining section, face each other. An arm section 122 is provided on the back surface of each of the die blocks 121, and a driving mechanism (not illustrated), such as a hydraulic cylinder or an electric motor, is connected via a power transmission mechanism to the end of the arm section. During the course of forging, the paired die blocks 121 are moved by means of the driving mechanism so as to be united together, thereby forming a forging die for the preliminary forging step.

After completion of forging, the die blocks 121 are separated from each other in opposite directions by means of the driving mechanism, and the resultant preform is removed from the die blocks.

Preferably, the arm section 122 provided on the back surface of each of the die blocks 121 is located at a position corresponding to the confluence of branch-corresponding portions of the cavity of the die, from the viewpoint of prevention of offset load application. In the case of forging of a preform requiring precise dimensions, a plurality of arm sections 122 are provided on predetermined positions of each of the die blocks 121, and a forging die formed of the die blocks is employed for forging.

In the case shown in FIG. 12, the driving mechanism is provided on both the die blocks. However, the driving mechanism may be provided on only one of the die blocks, and the die block may be moved by means of the mechanism toward the other die block, which is fixated, followed by forging by use of the forging die formed of the die blocks.

Figure 13:
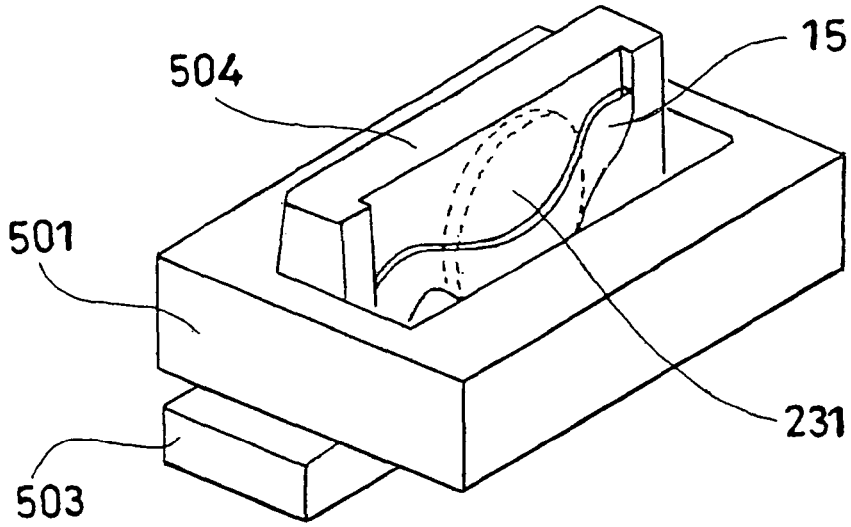
FIG. 13 is a schematic representation showing an embodiment of the die of the present invention for the preliminary forging step, FIG. 13(*a*) showing the appearance of the die on which a holder is mounted, FIG. 13(*b*) being a schematic representation showing the appearance of a portion of the die at which the holder is mounted, and FIG. 13(*c*) showing the relation between the position of a preform and the position of the holder.
Figure 13:
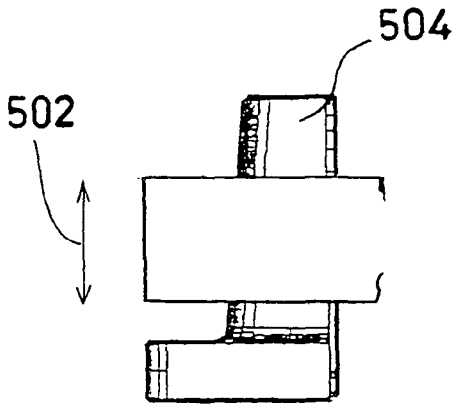
Figure 13:
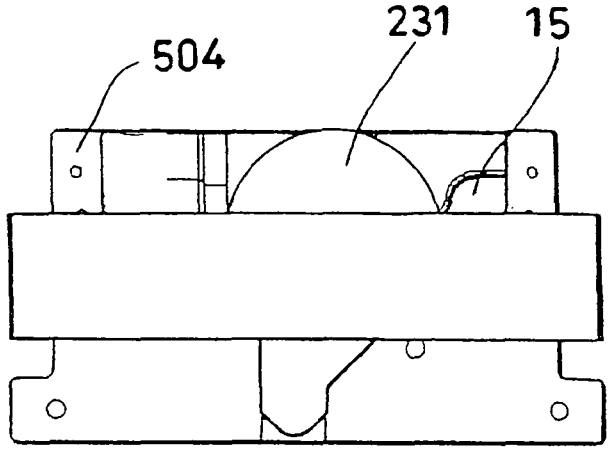

FIG. 13 schematically shows separate die blocks having a holder ring, which are another example of die blocks of a forging die employed in the preliminary forging step.

Die blocks 504 of a forging die (since the die blocks are symmetrical to each other, only one of the die blocks is shown in FIG. 13) are united by means of a holder ring 501. The holder ring may be mechanically fixated to one of the die blocks by means of bolts, for example, such that the united die blocks are not loosened. The position of the holder ring with respect to a thick portion 503 of the die block is regulated such that the forging die can endure load stress applied thereto while applying pressure. Preferably, the position of the thick portion or the position of the holder ring is determined so as to correspond to the confluence of branch-corresponding portions of the cavity of the forging die. FIG. 13(*c*) shows the case where the holder ring is provided at a position corresponding to the confluence of branch-corresponding portions of the cavity of the forging die.

The shape of the holder ring, the strength of the material thereof and the thermal expansion coefficient of the material are designed such that the die blocks 504 are not separated from each other when forging load is applied to the die blocks. For example, the material of the holder ring may be SCM435H. As shown in FIG. 13(*b*), the shape of the holder ring 501 may be designed such that a thickness 502 of the holder ring is, for example, 100 to 300 mm.

Preferably, the die blocks on which the holder ring is to be provided are designed so as to assume a tapered shape such that the holder ring is readily removed from the die blocks. With this configuration, the die blocks can be readily separated from each other, and thus a preform is readily removed from the die blocks. In addition, maintenance of the die blocks is readily performed.

When the die blocks are united through means for uniting and holding the die blocks, preferably, the uniting-holding means is provided on the die blocks such that the center of the means is located at a position corresponding to the confluence of branch-corresponding portions of the cavity of the forging die. With this structure, the forging die can reliably endure stress applied thereto during the course of pressure application, and the die blocks are not separated from each other during the course of pressure application. Since the die blocks are tightly held, metal penetration or formation of flashes can be prevented. In addition, metal flow occurs reliably, and plastic flow of a forging material sufficiently occurs along branches of a preform, and thus the surface layer of the forging material can be reliably accumulated in the surface region of the preform.

Employment of the aforementioned separate die blocks exhibits effects in addition to the effects obtained from the aforementioned closed-forging die. Specifically, a preform formed in the die blocks can be removed therefrom in a knock-out-stroke-independent manner, since the preform can be removed in a die block retracting direction, as well as in an upward direction.

In the present invention, the shape of a preform is designed such that the surface layer of the preform is extruded in the intermediate forging step and such that the yield of the preform becomes high. A limitation is imposed on the relation between the thickness of the forging material and that of the preform. In the preliminary forging step, the forging material is placed in the forging die such that the upper and lower surfaces of the forging material correspond to parallel surfaces of the preform and such that pressure is applied, by means of a punch (upper die block) of the forging die, onto the circumferential surface of the forging material, which circumferential surface has the surface layer. The relation between the positions of branch-corresponding portions of the cavity of the die and the load application direction of the punch is determined such that metal flow by means of load application occurs along the branches of the perform. As a result, the preform is formed such that the surface layer is contained in the surface region of the preform. Therefore, an undercut may be formed on the resultant preform. Even in such a case, when the forging die is formed of the separate die blocks, the preform can be readily removed from the forging die. The term "undercut" refers to a portion that prevents removal of the preform from the forging die. In the case where an undercut is present, event when a knock-out mechanism is employed, the preform cannot be removed from the forging die.

The cavity of the forging die is formed by means of direct carving (caving by use of a cutting tool) or electric discharge machining. In the present invention, in order to accumulate the surface layer of a forging material in the surface region of a preform, plastic flow resistance between the forging material and the inner wall of the forging die must be controlled. In order to attain such control, Rmax of the inner wall of the forging die is preferably regulated to 5 to 10 μm. In order to regulate Rmax of the inner wall to such a level, the inner wall is subjected to, for example, polishing, after formation of the cavity.

The height (in a depth direction) of the forging die employed for forming a preform having branches is greater than the thickness thereof (e.g., the thickness is 20 to 40 mm, and the height is 200 to 400 mm). Therefore, difficulty is encountered in sufficiently polishing the ends of branch-corresponding portions of the cavity of the die.

In the case of the separate-type forging die, the entirety of the cavity (including the ends of branch-corresponding portions) can be sufficiently subjected to polishing. Therefore, plastic flow resistance between the forging material and the inner wall of the die is reliably controlled.

Since the separate-type forging die can be separated into die blocks, lubrication oil is readily sprayed throughout the die, and maintenance of the surface of the die blocks is readily performed.

In the case where no undercut is formed on a preform, as in the case of the conventional die, a matrix die may be shrink-fitted onto the periphery of separate die blocks, and compression stress may be applied to the die blocks so as to cancel out stress in an outward direction during the course of forging, thereby preventing separation of the die blocks.

In the present invention, preferably, the preliminary forging step is carried out under the below-described conditions. In the case where an aluminum alloy is employed as a forging material, the die temperature is preferably 100 to 300° C., the material temperature is preferably 400 to 550° C. (500 to 550° C. in the case where the aluminum alloy is, for example, SU 610 alloy), the lubricant to be employed is preferably a water-soluble lubricant (graphite), and the forging load is preferably 50 to 1,000 t (more preferably 100 to 600 t).

In the present invention, preferably, the intermediate forging step is carried out under the below-described conditions. In the case where an aluminum alloy is employed as a forging material, the die temperature is preferably 100 to 300° C., the material temperature is preferably 400 to 550° C. (500 to 550° C. in the case where the aluminum alloy is, for example, SU 610 alloy), the lubricant to be employed is preferably a water-soluble lubricant (graphite), and the forging load is preferably 1,000 to 5,000 t (more preferably 1,500 to 4,000 t).

In the present invention, preferably, the final forging step is carried out under the below-described conditions. In the case where an aluminum alloy is employed as a forging material, the die temperature is preferably 100 to 300° C., the material temperature is preferably 400 to 550° C. (500 to 550° C. in the case where the aluminum alloy is, for example, SU 610 alloy), the lubricant to be employed is preferably a water-soluble lubricant (graphite), and the forging load is preferably 1,000 to 5,000 t (more preferably 1,500 t to 4,000 t).

For conversion of the forging load, the following relation can be employed: 1 t=9.8 kN.

The metal forged product production system of the present invention employs the forging die for the preliminary forging step having a cavity including a forging space which is designed such that there can be produced therein a preform having a surface layer in its surface region and no flash removal mark on the surface region, having a plurality of branches and having metal flow in a longitudinal direction of the branches. Therefore, through use of the production system, a preform can be readily formed from a cylindrical material having a surface layer on a circumferential surface thereof such that the surface layer is contained in a surface region of the preform. Thus, when the production system is employed, the cylindrical material having a surface layer which may cause lowering of the quality of a forged product can be subjected to forging without any preliminary treatment of the material, and thus a step of removing the surface layer is omitted. In addition, lowering of the yield of the preform on the basis of the forging material, which is caused by removal of the surface layer, can be prevented, and therefore productivity is enhanced.

Furthermore, load to be applied during forging can be reduced, and the mechanical strength of the preform can be enhanced.

The metal forged product production system of the present invention employs the forging die for the intermediate forging step including a punch and die blocks and having a cavity including a forging space which is designed such that the surface layer of the preform, which surface layer is contained in the surface region thereof, can be extruded in the form of flash outside a product-shape-determining section of the cavity. Therefore, through use of the production system, a forged product can be readily produced from the preform having the surface layer in its surface region such that the surface layer is extruded in the form of flash outside the periphery of a target-product-corresponding portion of the forged product. Thus, when the production system is employed, the forged product having the extruded surface layer in the form of flash can be readily produced from the forging preform, which has been produced through forging of the forging material having the surface layer without any treatment of the material. Therefore, a step of removing the surface layer is omitted, and lowering of the yield of the forged product on the basis of the forging material, which is caused by removal of the surface layer, can be prevented, leading to enhancement of productivity.

The present invention will next be descried in more detail by way of Examples (production of upper arm), which should not be construed as limiting the invention thereto.

EXAMPLE 1

In order to produce, through the preliminary forging step, a preform of an upper arm shown in FIG. 6(*a*), which is a suspension part for an automobile, a cut piece of JIS 6061 aluminum alloy (i.e., forging material) having the same volume as the preform was designed as follows.

The volume of the upper arm preform was calculated by means of a CAD system programmed in a computer. On the basis of the results of the calculation, the volume of a cut piece was designed to be 862 $cm^3$. The volume tolerance of the cut piece was determined to be ±1% on the basis of the calculated volume of the preform.

Figure 16:
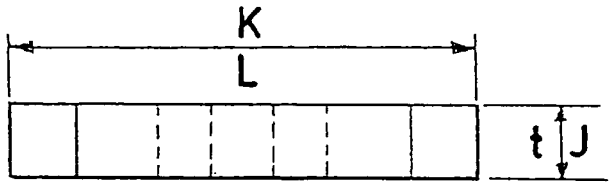
FIG. 16 shows a projection profile perpendicular to the direction of pressure application shown in FIG. 1.

Subsequently, the thickness of the cut piece was designed to be 28 mm, which is 0.95 times the lateral length (t) represented by reference letter J (shown in FIG. 16) of a projection profile of the preform, the projection profile being formed in a direction perpendicular to the direction of pressure application I shown in FIG. 1. On the basis of the volume and thickness of the cut piece, the diameter (R) of the cut piece was determined by use of the following equation: $R=2\times[862,000/(28\pi)]^{1/2}$. Here, R satisfies the following condition: (⅓)× (longitudinal length (L) represented by reference letter K of FIG. 16)≦R≦(longitudinal length (L) represented by reference letter K of FIG. 16).

On the basis of the aforementioned design, a continuously cast billet material of JIS 6061 aluminum alloy (diameter: 198 mm) was cut into 10 disk-shaped pieces (cylindrical materials), each piece having a diameter of 198 mm, a thickness of 28 mm and a volume of 862 $cm^3$. The 10 cut pieces had an average weight of 2,330 g.

The billet material employed had an "as-cast" casting surface and was not subjected to peeling treatment. In the surface layer of the billet material, the surface region (including an inverse segregation layer) having a thickness of 2 mm or less as measured from the surface of the material was found to have a disturbed structure.

Figure 1:
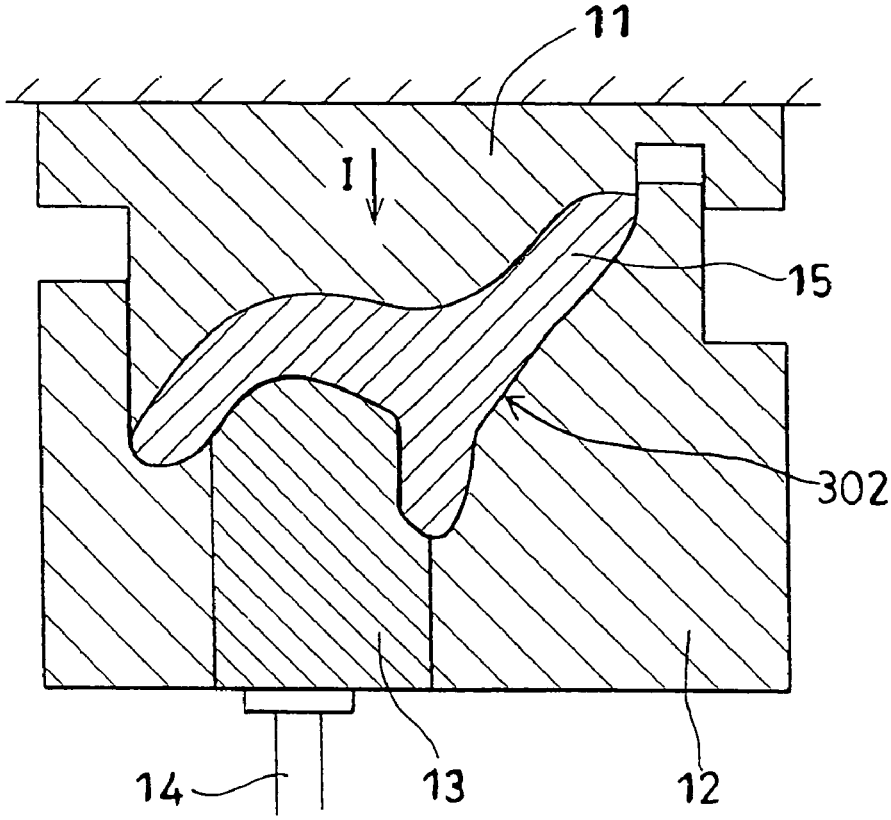
FIG. 1 shows an embodiment of the present invention and is a cross-sectional view showing the state where an upper die block reaches a drop end when a forging preform of an upper arm, which is a suspension part for a vehicle, is produced through forging in the preliminary forging step.

A forging die shown in FIG. 1 and separate die blocks 121 having a driving mechanism, shown in FIG. 12, were employed. One of the die blocks was fixated, and the other die block was mechanically driven. The die blocks were united together while a punch was operated by means of a forging machine, and the die blocks were separated from each other after forging was completed and the punch reached the top dead point of the forging machine.

In FIG. 1, reference numeral 11 denotes a punch, 12 die blocks, 13 a knock-out, 14 a knock-out mechanism, and 15 a forging preform of an upper arm.

Figure 17:
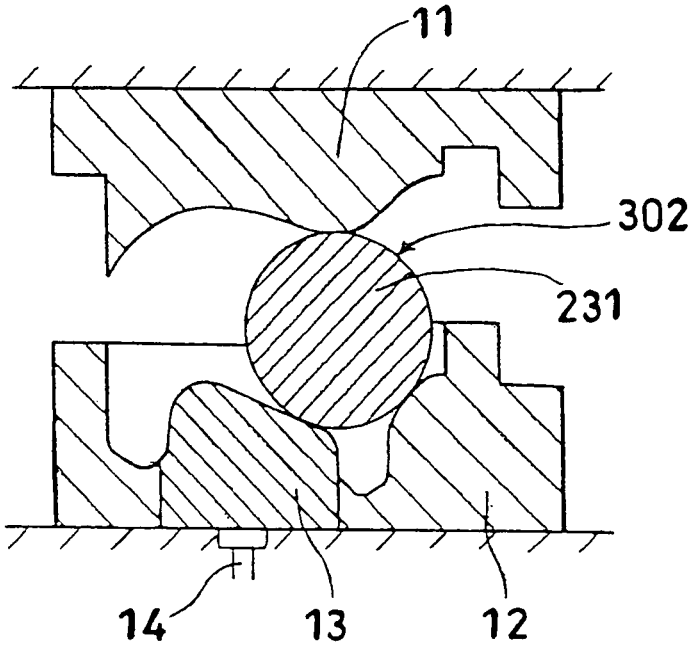
FIG. 17 shows the state where a forging material is placed in the die shown in FIG. 1 before forging.

A conventionally known water-soluble graphite lubricant was applied to the surface of each of the disk-shaped cut pieces 231 and sprayed onto the forging die. Subsequently, the cut piece was placed in the die as shown in FIG. 17, and load was applied onto the outer peripheral surface (including a surface layer 302) of the cut piece by use of the punch, whereby hot forging was performed. A 3,000-t press (product of Sumitomo Heavy Industries, Ltd.) was employed as a forging apparatus. Hot forging was performed under the following conditions: material heating temperature: 500° C., die temperature: 200° C. The average forging load was 6,370 kN. The average weight of the resultant preforms was found to be 2,328 g. The projection profiles of the preforms had an average longitudinal length (L) (represented by K in FIG. 16) of 392 mm, the projection profiles being formed in a direction perpendicular to the direction of pressure application.

The yield by weight of the preform on the basis of the forging material was found to be about 99%.

The surface layer of the forging material observed was distributed throughout a circumferential surface 62 of the preform, and parallel surfaces 63 of the preform were found not to have the surface layer (FIG. 6). The cross sections of three branches of the preform were observed, and as a result, the surface layer was observed in a region having a thickness of 5 mm or less as measured from the surface of the preform.

Since stratiform plastic flow of the forging material occurred along a plurality of branches of the preform, the mechanical strength of the preform was improved. In addition, since the preform was produced through closed forging from the forging material having the surface layer, the preform had no trimming mark, and the yield of the preform on the basis of the forging material was high.

Figure 5:
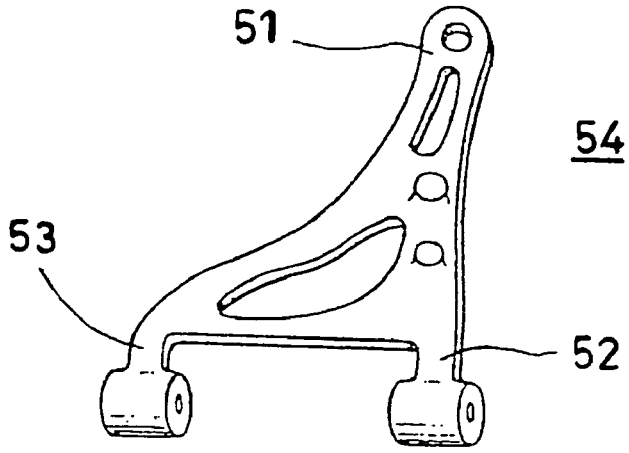
FIG. 5 shows the appearance of an upper arm produced from a preform according to an embodiment of the present invention.

The thus produced preform was subjected to hot forging with a flash being formed (the intermediate forging step) by use of the forging die shown in FIG. 14 to thereby produce a forged product shown in FIG. 6(*b*). Thereafter, the forged product was subjected to the final forging step, and subsequently the flash was removed to thereby produce an upper arm 54 shown in FIG. 5. The intermediate forging step was performed under the following conditions: material heating temperature: 500° C., die temperature: 150° C., forging load: 22,540 kN. The final forging step was performed under the following conditions: material heating temperature: 500° C., die temperature: 150° C., forging load: 17,640 kN. After completion of forging, the flash was removed from the forged product by use of a trimming die to thereby produce a target product. The weight of the upper arm product shown in FIG. 5 was found to be 1,650 g. Therefore, the yield by weight of the upper arm product on the basis of the forging material (average weight of the disk-shaped cut pieces: 2,330 g) was calculated to be 71%.

The flash that had been removed by use of the trimming die was observed, and the flash was found to contain the surface layer of the forging material. In contrast, the upper arm product was found not to contain the surface layer of the forging material, as a result of observation of the appearance of the product.

COMPARATIVE EXAMPLE 1

Figure 7:
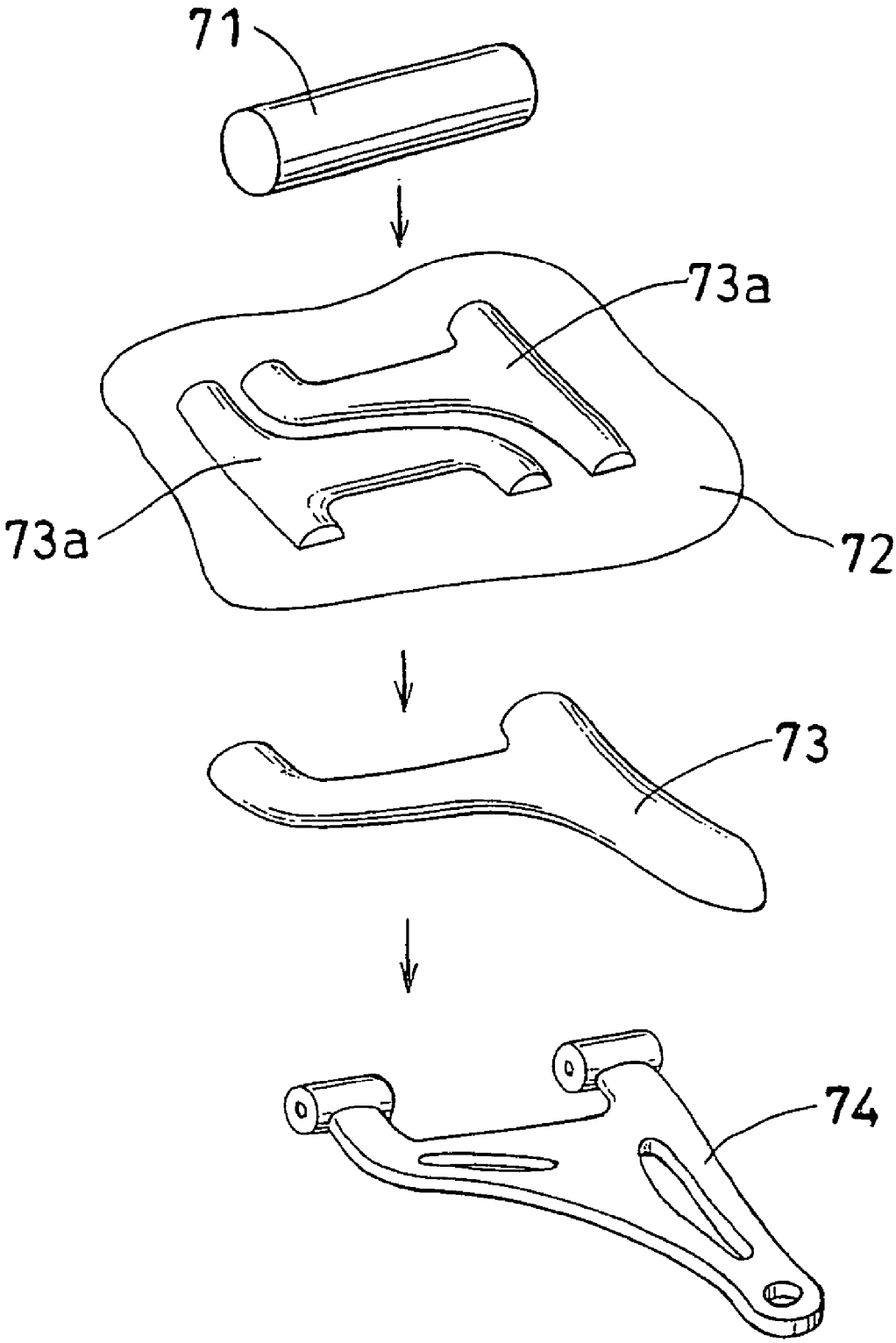
FIG. 7 is a schematic representation showing a conventional hot-forging method for producing an upper arm with flashes being formed.
Figure 8:
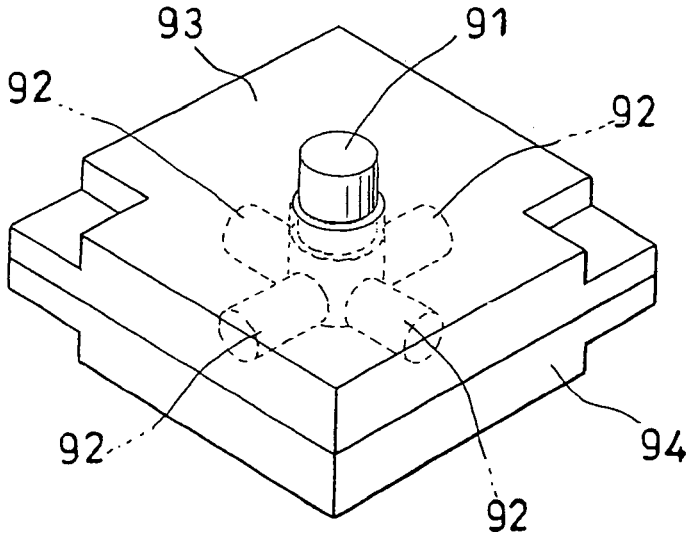
FIG. 8 is a schematic representation showing a conventionally known closed forging method.

A preform of an upper arm shown in Example 1 was produced through conventional hot forging shown in FIG. 7 with a flash being formed. Hot forging was performed under the following conditions: material heating temperature: 500° C., die temperature: 180° C. A cut piece serving as a forging material, having a diameter of 80 mm, a length of 360 mm, a volume of 1,810 $cm^3$ and a weight of 4,900 g, was obtained from a continuously cast round bar of JIS 6061 aluminum alloy (diameter: 80 mm). The peripheral portion (thickness: 2 mm) of the continuously cast round bar employed was subjected to peeling treatment.

In this hot forging, forging load was 49,000 kN. After completion of the forging, the resultant flash was removed by use of a trimming die to thereby yield a preform. In this forging process, two upper arm preforms were produced from one piece of forging material. The average weight of the two preforms was 1,960 g. Forging load required for producing one preform was calculated by halving the aforementioned forging load and determined to be about 24,500 kN. The yield by weight of the preform on the basis of the forging material was found to be 80%.

In a manner similar to that of Example 1, the above-produced preform was subjected to the intermediate forging step and the final forging step, and subsequently the resultant flash was removed to thereby produce an upper arm 74 shown in FIG. 7. These forging steps were performed under the following conditions: material heating temperature: 500° C., die temperature: 180° C.

In the intermediate forging step, forging load was 14,700 kN, and in the final forging step, forging load was 14,700 kN. After completion of the forging, the flash was removed by use of a trimming die to thereby produce a target product (upper arm product). Since two upper arm products 74 shown in FIG. 7 (weight: 1,650 g each) were obtained from the cut piece (solid round bar 71) having a weight of 4,900 g, the yield by weight of the upper arm products on the basis of the forging material was calculated to be about 67%. The total yield of the target product on the basis of the forging material was estimated in consideration that a portion of the forging material was removed through peeling treatment.

EXAMPLE 2

Figure 18:
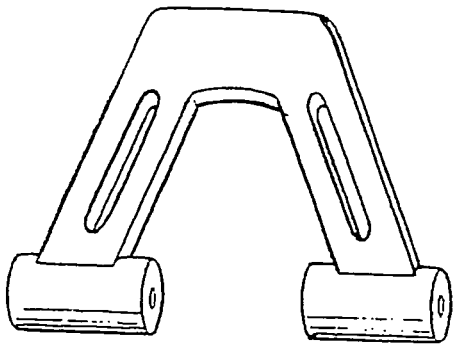
FIG. 18 shows the appearance of another upper arm, which is a suspension part for a vehicle, produced from a forging preform according to an embodiment of the present invention.
Figure 19:
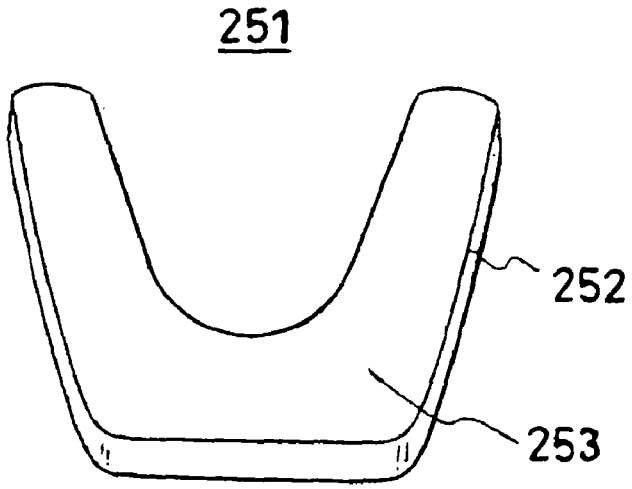
FIG. 19 shows the appearance of a forging preform according to another embodiment of the present invention, which is used for producing the upper arm shown in FIG. 18.

In order to produce an upper arm shown in FIG. 18, which is a suspension part for a vehicle, a forging preform shown in FIG. 19 of the upper arm was produced. A cut piece of JIS 6061 aluminum alloy (i.e., forging material) that had the same volume as the preform, was designed as follows.

The volume of the upper arm preform was calculated by means of a CAD system programmed in a computer. On the basis of the results of the calculation, the volume of a cut piece was designed to be 595 $cm^3$. The volume tolerance of the cut piece was determined to be ±1% on the basis of the calculated volume of the preform.

Subsequently, the thickness of the cut piece was designed to be 30 mm, which is 0.95 times the lateral length (t) represented by reference letter N (shown in FIG. 21) of a projection profile of the preform, which profile is formed in a direction perpendicular to the direction of pressure application M shown in FIG. 20. On the basis of the volume and thickness of the cut piece, the diameter (R) of the cut piece was determined by use of the equation: $R=2\times[595{,}000/(30\pi)]^{1/2}$. Here, R satisfies the condition: (⅓)×(longitudinal length (L) represented by reference letter O of FIG. 21)≦R≦(longitudinal length (L) represented by reference letter O of FIG. 21).

Figure 20:
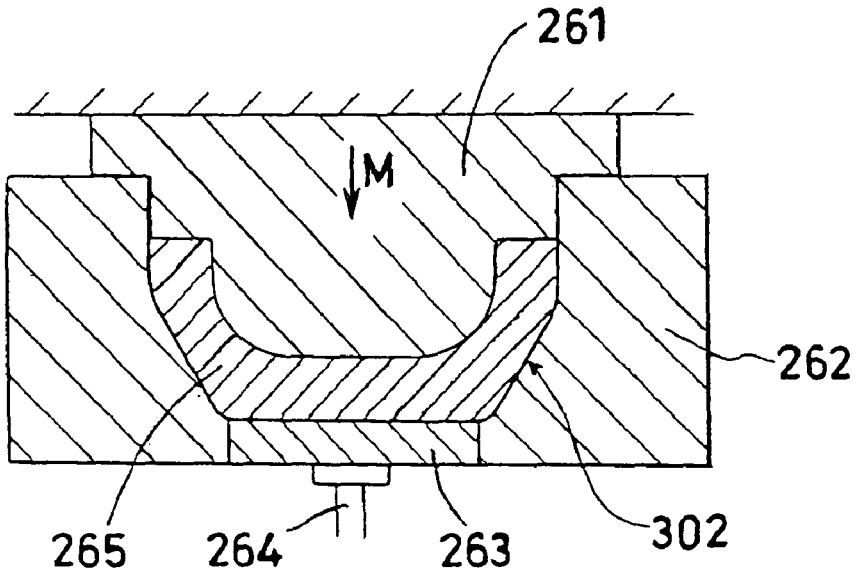
FIG. 20 is a cross-sectional view showing the state where the preform shown in FIG. 19 is produced through the preliminary forging step.
Figure 21:
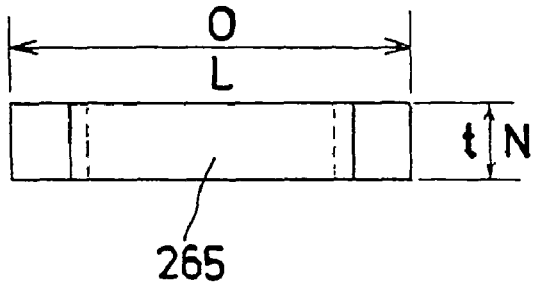
FIG. 21 shows a projection profile perpendicular to the direction of pressure application shown in FIG. 20.

In FIG. 20, reference numeral 261 denotes a punch, 262 die blocks, 263 a knock-out, 264 a knock-out mechanism, and 265 a forging preform of an upper arm.

On the basis of the aforementioned design, a continuously cast billet material of JIS 6061 aluminum alloy (diameter: 167 mm) was cut into 10 disk-shaped pieces, each having a diameter of 167 mm, a thickness of 30 mm and a volume of 595 $cm^3$. The 10 cut pieces had an average weight of 1,607 g.

The billet material employed had an "as-cast" casting surface, and the material was not subjected to peeling treatment. In the surface layer of the billet material, the surface region (including an inverse segregation layer) having a thickness of 1.5 mm or less as measured from the surface of the material was found to have a disturbed structure.

Figure 22:
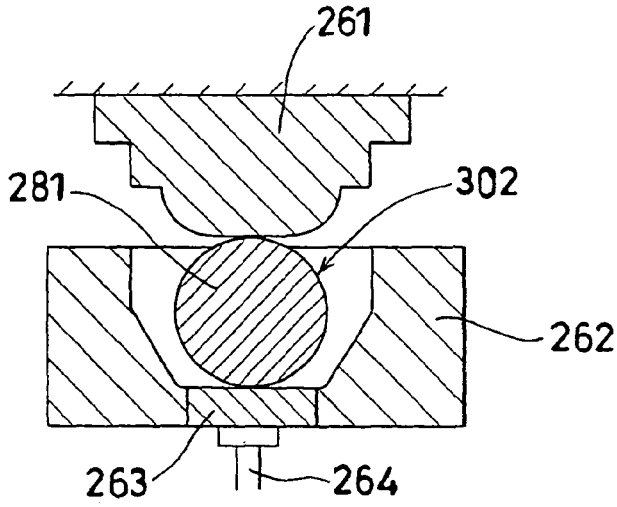
FIG. 22 shows the state where a forging material is placed in the die shown in FIG. 20 before forging.

A conventionally known water-soluble graphite lubricant was applied to the surface of each of the disk-shaped cut pieces 281 shown in FIG. 22, and a conventionally known water-soluble graphite lubricant was sprayed onto a forging die. Subsequently, the cut piece was placed in the die as shown in FIG. 22, and load was applied onto the outer peripheral surface (including a surface layer 302) of the cut piece by use of the punch to perform hot forging. A 600-t press (product of Komatsu) was employed as a forging apparatus. Hot forging was performed under the following conditions: material heating temperature: 500° C., die temperature: 200° C. The average forging load was 4,900 kN.

The average weight of the resultant preforms was found to be 1,800 g. The projection profiles of the preforms had an average longitudinal length (L) (represented by O in FIG. 21) of 310 mm, the projection profiles being formed in a direction perpendicular to the direction of pressure application.

The yield by weight of the preform on the basis of the forging material was found to be 99%.

The surface layer of the forging material observed was distributed throughout a circumferential surface 252 of the preform 251 (FIG. 19), and parallel surfaces 253 of the preform were found not to have the surface layer. The cross sections of two branches of the preform were observed, and as a result, the surface layer was observed in a region having a thickness of 2 mm or less as measured from the surface of the preform.

Since stratiform plastic flow of the forging material occurred along a plurality of branches of the preform, the mechanical strength of the preform was improved. In addition, since the preform was produced through closed forging from the forging material having the surface layer, the preform had no trimming mark, and the yield of the preform on the basis of the forging material was high.

EXAMPLE 3

Forging was performed under the same forging conditions as those employed in Example 1, except that the aluminum alloy species serving as a forging material was changed as described below.

In order to produce, through forging, a preform of an upper arm shown in FIG. 6(*a*), which is a suspension part for an automobile, there was employed, as a forging material, a cut piece of a continuously cast round bar of SU 610 aluminum alloy (Mg: 0.8 to 1.2 wt. %, Si: 0.7 to 1.0 wt. %, Cu: 0.3 to 0.6 wt. %, Cr: 0.14 to 0.3 wt. %, Mn: 0.14 to 0.3 wt. %, and Al and impurities: balance), the cut piece having the same volume as the preform.

The yield by weight of the preform on the basis of the forging material was found to be about 99%.

The surface layer of the forging material observed was distributed throughout a circumferential surface 62 of the preform, and parallel surfaces 63 of the preform were found not to have the surface layer. The cross sections of three branches of the preform were observed, and as a result, the surface layer was observed in a region having a thickness of 2 mm or less as measured from the surface of the preform.

COMPARATIVE EXAMPLE 2

Forging was performed under the same forging conditions as those employed in Comparative Example 1, except that the alloy species employed in Example 3 was employed as a forging material.

Figure 9:
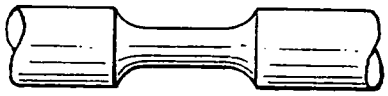
FIG. 9 shows a tensile test piece.

The forged upper arm product produced through the closed forging method of the present invention (Example 3) and the forged upper arm product produced from the preform obtained through conventional hot forging with a flash being formed (Comparative Example 2) were subjected to heat treatment; i.e., solid solution treatment (at 530° C. for six hours) and aging treatment (at 180° C. for six hours). Thereafter, a tensile test piece ASTM-R3 shown in FIG. 9 (diameter of a portion between gauge points: 6.4 mm, distance between gauge points: 25.4 mm) was obtained through cutting from each of the forged products at a position corresponding to portion Q shown in FIG. 6(*a*), and mechanical properties of the test piece were evaluated. The tensile test was performed by use of Autograph (product of Shimadzu Corporation) at a tensile load of 20 kN. Three test pieces (for each of the forged products) were subjected to the tensile test. Data of mechanical properties obtained through the tensile test are shown in Table 1.

TABLE 1

| | Test piece number | Tensile strength ($N/mm^2$) | 0.2% Proof stress ($N/mm^2$) | Elongation (%) |
|---|---|---|---|---|
| Example 3 | 1 | 385 | 333 | 16.6 |
| | 2 | 387 | 333 | 15.9 |
| | 3 | 385 | 331 | 15.7 |
| | Average | 386 | 332 | 16.1 |
| Comparative Example 2 | 1 | 358 | 330 | 12.2 |
| | 2 | 362 | 323 | 10.4 |
| | 3 | 356 | 325 | 8.4 |
| | Average | 359 | 326 | 10.3 |

As is clear from Table 1, the tensile strength, 0.2% proof stress and elongation of the forged upper arm product produced through the closed forging method of the present invention are higher than those of the forged upper arm product produced from the preform obtained through conventional hot forging with a flash being formed. That is, the forged product of the present invention exhibits improved mechanical properties.

Subsequently, in order to observe metal flow in branches of each of the forged upper arm products and to observe crystal grains in a region of the forged product corresponding to the vicinity of a parting line of the preform, a sample for macrostructure observation was obtained from the forged product through cutting. The surface of the sample, at which the macrostructure was to be observed, was polished by use of emery paper, and then the sample was subjected to etching treatment; i.e., the sample was immersed in a 20% sodium hydroxide solution for 30 seconds. The macrostructure of the resultant sample was visually observed, whereby metal flow and crystal grains in the region corresponding to the vicinity of a parting line of the preform were evaluated.

As a result, in the forged product produced through the method of the present invention, forging defects, such as overlap, were not observed, since a corner edge at which the cut surface of the forging material met the outer peripheral surface thereof fell on the peripheral outline of the forged product. Furthermore, at the center portions of a plurality of branches of the forged upper arm product, uniform metal flow was observed to run in a longitudinal direction of the branches. In addition, layers of metal flow were found not to end at the surface of the forged product, and disturbance of the layers was not observed. The results show that stratiform plastic flow of the forging material occurs along branches of the forged product. In the case of the forged product produced through the method of the present invention, unlike the case of the forged product produced through the conventional method, an increase in crystal grain size was not observed since the forged product of the present invention was produced from the preform having no parting line.

In contrast, through observation, under the aforementioned conditions, of the macrostructure of the forged upper arm product produced through conventional hot forging with a flash being formed, metal flow was observed to occur other than along a plurality of branches of the forged product. In the case of the conventional forged product, an increase in crystal grain size was observed in the region corresponding to the vicinity of a parting line of the preform.

EXAMPLE 4

Forging was performed under the same forging conditions as those employed in Example 3, except that a separate-type die shown in FIG. 13 having a holder ring was employed as a forging die.

As a result of production of a preform under the aforementioned conditions, forging defects, such as sticking, were not generated on the preform, and problems, such as a drastic increase in forging load, did not arise.

The surface layer of the forging material observed was distributed throughout a circumferential surface of the preform, and parallel surfaces of the preform were found not to have the surface layer. The cross sections of three branches of the preform were observed, and as a result, the surface layer was observed in a region having a thickness of 5 mm or less as measured from the surface of the preform.

EXAMPLE 5

In order to produce, through the preliminary forging step, a preform shown in FIG. 29, a cut piece of JIS 6061 aluminum alloy having the same volume as the preform was designed as follows.

The volume of the preform was calculated by means of a CAD system programmed in a computer. On the basis of the results of the calculation, the volume of a cut piece was designed to be 231 $cm^3$. The volume tolerance of the cut piece was determined to be ±1% on the basis of the calculated volume of the preform.

Subsequently, the thickness of the cut piece was designed to be 68 mm, which is 0.97 times the lateral length (t) represented by reference letter U (shown in FIG. 30) of a projection profile of the preform, the projection profile being formed in a direction perpendicular to the direction of pressure application I shown in FIG. 31. On the basis of the volume and thickness of the cut piece, the diameter (R) of the cut piece was determined by use of the following equation: $R=2\times[231,000/(68\pi)]^{1/2}$. Here, R satisfies the following condition: $(1/3)\times L \leqq R=2\times(V/T\pi)^{1/2} \leqq L$.

On the basis of the aforementioned design, a continuously cast billet material of JIS 6061 aluminum alloy (diameter: 68 mm) was cut into 10 disk-shaped pieces (cylindrical materials), each having a diameter of 68 mm, a thickness of 63.5 mm and a volume of 231 $cm^3$. The 10 cut pieces had an average weight of 621 g.

The billet material employed had an "as-cast" casting surface and was not subjected to peeling treatment. In the surface layer of the billet material, the surface region (including an inverse segregation layer) having a thickness of 2 mm or less as measured from the surface of the material was found to have a disturbed structure.

A forging die shown in FIG. 31 was employed. In FIG. 31, reference numeral 321 denotes a punch, 322 die blocks, 324 a knock-out, and 325 a forging perform.

A conventionally known water-soluble graphite lubricant was applied to the surface of each of the disk-shaped cut pieces 331 shown in FIG. 32 and sprayed onto the forging die. Subsequently, the cut piece was placed in the die as shown in FIG. 33, and load was applied onto the outer peripheral surface (including a surface layer 332) of the cut piece by use of the punch, whereby hot forging was performed. A 600-t press (product of Komatsu) was employed as a forging apparatus. Hot forging was performed under the following conditions: material heating temperature: 500° C., die temperature: 200° C. The average forging load was 5,096 kN. The average weight of the resultant preforms was found to be 620 g. The projection profiles of the preforms had an average longitudinal length (L) (represented by W in FIG. 30) of 127 mm, the projection profiles being formed in a direction perpendicular to the direction of pressure application.

The yield by weight of the preform on the basis of the forging material was found to be about 99%.

The surface layer of the forging material observed was distributed throughout a circumferential surface 352 of the perform shown in FIG. 34, and parallel surfaces 351 of the preform were found not to have the surface layer. The cross sections of three branches of the preform were observed, and as a result, the surface layer was observed in a region having a thickness of 5 mm or less as measured from the surface of the preform.

Since stratiform plastic flow of the forging material occurred along a plurality of branches of the preform, the mechanical strength of the preform was improved. In addition, since the preform was produced through closed forging from the forging material having the surface layer, the preform had no trimming mark, and the yield of the preform on the basis of the forging material was high.

COMPARATIVE EXAMPLE 3

Hot forging was performed using a disk-shaped cut material (cylindrical material) that is the same as that employed in Example 5, with the cut material placed as shown in FIG. 35, and load is applied by means of a punch onto the outer peripheral surface of the cut material, which surface contains s surface layer 332, to complete the hot forging. The hot forging was performed under the following conditions: material heating temperature: 500° C., die temperature: 180° C.

The yield by weight of the preform on the basis of the forging material was found to be about 99%.

The surface layer of the forging material observed was distributed throughout not only the circumferential surface 352 but also the parallel surfaces 351 of the preform shown in FIG. 34.

Since the disposition of the forging material in Comparative Example 3 differed from that employed in the present invention, the position of the forging material to be introduced into the die was not determined as shown in FIGS. 36(*a*) and 36(*b*). For this reason, the forging load varied between 5,000 N and 6,000 N inclusive, and the operation became unstable. In addition, underfills, one of the forging defects, were generated in the branches of the preform and overlaps caused by corner portions of the cut surface were also generated, resulting in failure to obtain forged products good in quality.

INDUSTRIAL APPLICABILITY

The method of the present invention for producing a metal forged product having a plurality of branches, includes a preliminary forging step of forming a preform through closed forging from a cylindrical material having a surface layer on a circumferential surface thereof such that the surface layer is contained in a surface region of the perform, and a forging step of subjecting the preform to forging to thereby extrude the surface layer in the form of flash outside the periphery of a target-product-corresponding portion of a forged product. When a forged product is produced through the production method, the forged product exhibits improved mechanical properties since stratiform plastic flow of a forging material occurs along a plurality of branches of the forged product. In the production method, since a cylindrical forging material having a surface layer on its circumferential surface is employed, the number of processing steps can be reduced, and the yield of a target product on the basis of the forging material can be increased. The production method can produce a suspension part for a vehicle or a preform of the part at low cost and in an efficient manner.

In the forging preform of an upper arm or lower arm of the present invention, which is a suspension part for a vehicle, stratiform plastic flow of a forging material occurs along a plurality of branches of the preform. Therefore, the preform exhibits improved mechanical properties. In addition, the preform has no trimming mark. Since the preform is produced from a cylindrical forging material having a surface layer on its circumferential surface, the number of processing steps can be reduced, and the yield of the preform on the basis of the forging material can be increased.

The invention claimed is:

1. A method for producing a metal forged product having a plurality of branches, comprising:

forming a preform by closed forging in a first forging die a cylindrical forging material having a circumferential surface of which a surface layer is formed to a surface region of the preform, said surface layer being a layer that comprises the entire circumferential surface of the cylindrical forging material and from which material has not been removed, by applying pressure onto the circumferential surface of the forging material;

removing the preform from the first forging die and placing the preform in an open second forging die;

subjecting the preform to open forging in the second forging die to thereby extrude the entire circumferential surface in a form of flash outside a periphery of a forged product corresponding to a target product; and subsequently disposing the preform in a die for a final forging step wherein the cylindrical forging material has an upper surface, a lower surface and the circumferential surface, has a volume which is the same as the volume of the preform, has a shape such that a ratio of a thickness T of the forging material to a diameter R of the forging material is 1 or less, and has a cut surface that meets the circumferential surface at an edge which falls on the peripheral outline of the forged product wherein a shape of the perform is designed by following simulation steps (a) to (e):

(a) obtaining a cross-sectional shape of a final product at a point in a longitudinal direction of a shape of the final product by using three- dimensional CAD data of the shape of the final product, and obtaining a width and a cross-sectional area of the product at the point from the obtained cross-sectional shape, creating a rectangle having a lateral width corresponding to the obtained width and an area corresponding to the obtained cross-sectional area, and obtaining a height of the rectangle;

(b) taking, as a tentative fundamental height of the preform, a largest height of heights of the rectangle in accordance with the method of (a) obtained severally at the individual portions of the sectional shapes and the sectional areas which are obtained at all the portions of the shape of the product, wherein the taking comprises repeating step (a) at multiple points to obtain a height at each point, and selecting a maximum height among the obtained heights to be the initial thickness of a designed preform;

(c) setting a rectangle determined by the width and the thickness from steps (a) and (b) as the designed preform having initial values which define a cross-sectional area of the rectangle;

(d) comparing the cross-sectional area of the shape of the preform having the initial values with a cross-sectional area of the shape of the product at a position of the cross-sectional area of the shape of the preform; and (e) modifying the preform so that its width becomes small until the cross-sectional area of the preform shape is equal to the cross-sectional area of the product shape when (the cross-sectional area of the product shape)< (the cross-sectional area of the preform shape) as a result of (d) and repeating (d) and (e).

2. A method for producing a metal forged product having a plurality of branches, comprising:

forming a preform by closed forging in a first forging die a cylindrical forging material having a circumferential surface of which a surface layer is formed to a surface region of the preform, said surface layer being a layer that comprises the entire circumferential surface of the cylindrical forging material and from which material has not been removed, by applying pressure onto the circumferential surface of the forging material;

removing the preform from the first forging die and placing the preform in an open second forging die;

subjecting the preform to open forging in the second forging die to thereby extrude the entire circumferential surface in a form of flash outside a periphery of a forged product corresponding to a target product;

forging the forged product into a product having a target product shape; and removing the flash containing the surface layer from the product having a target product shape to thereby produce a target forged product, wherein the cylindrical forging material has an upper surface, a lower surface and the circumferential surface, has a volume which is the same as the volume of the preform, has a shape such that a ratio of a thickness T of the forging material to a diameter R of the forging material is 1 or less, and has a cut surface that meets the circumferential surface at an edge which falls on the peripheral outline of the forged product wherein a shape of the preform is designed by following simulation steps (a) to (e):

(a) obtaining a cross-sectional shape of a final product at a point in a longitudinal direction of a shape of the final product by using three-dimensional CAD data of the shape of the final product, and obtaining a width and a cross-sectional area of the product at the point from the obtained cross-sectional shape, creating a rectangle having a lateral width corresponding to the obtained width and an area corresponding to the obtained cross-sectional area, and obtaining a height of the rectangle;

(b) taking, as a tentative fundamental height of the preform, a largest height of heights of the rectangle in accordance with the method of (a) obtained severally at the individual portions of the sectional shapes and the sectional areas which are obtained at all the portions of the shape of the, wherein the taking comprises repeating step (a) at multiple points to obtain a height at each point, and selecting a maximum height among the obtained heights to be the initial thickness of a designed preform;

(c) setting a rectangle determined by the width and the thickness from steps (a) and (b) as the designed preform having initial values which define a cross-sectional area of the rectangle;

(d) comparing a cross-sectional area of the shape of the preform having the initial values with a cross-sectional area of the shape of the product at a position of the cross-sectional area of the shape of the preform; and (e) modifying the preform so that its width becomes small until the cross-sectional area of the preform shape is equal to the cross-sectional area of the product shape when (the cross-sectional area of the product shape)< (the cross-sectional area of the preform shape) as a result of (d) and repeating (d) and (e).

3. The method according to claim 1 or claim 2, wherein the surface layer is a layer containing a portion formed of any one of species selected from among a casting surface, an inverse segregation layer and an oxide-containing layer, or a combination of two or more of the species.

4. The method according to claim 1 or claim 2, wherein the surface layer is a layer having a thickness of 5 mm or less as measured from the circumferential surface of the cylindrical forging material.

5. The method according to claim 1 or claim 2, wherein the surface region of the preform has a thickness of 7 mm or less as measured from a surface of the preform.

6. The method according to claim 1 or claim 2, wherein the cylindrical forging material is obtained by cutting a round bar material and has a volume which is the same as a volume (V) of the preform, wherein a ratio T/R of a thickness (T) of the cylindrical forging material to a diameter (R) of the cylindrical forging material is 1 or less.

7. The method according to claim 1 or claim 2, wherein the volume (V) of the preform, the thickness (T) of the cylindrical forging material, a longitudinal length (L) of the preform, and the diameter (R) of the cylindrical forging material satisfy $(1/3)\times L \leqq R = 2\times(V/T\pi)^{1/2} \leqq L$.

8. The method according to claim 1 or claim 2, wherein the thickness (T) of the cylindrical forging material is (0.8 to 1.0)×the width of the preform.

9. The method according to claim 1, wherein the forging of the preform is performed in a state in which, in a cavity region of the second forging die in which a portion of the preform that has a thickness smaller than that of a corresponding portion of a forged product is subjected to forging, the surface region of the preform is located above a surface-layer-extruding section provided outside a section of the cavity, which section determines the shape of a forged product; and in a state in which, in a cavity region in which a portion of the preform that has a thickness greater than that of a corresponding portion of a forged product is subjected to forging, the surface region of the preform is located inward from an end, on a side of the section, of a portion of the cavity, which portion is provided outside the section and has a level equal to or lower than that of the section.

10. The method according to claim 1 or claim 2, wherein the cylindrical forging material is formed of aluminum or an aluminum alloy.

11. The method according to claim 1 or claim 2, wherein the forged product is an upper arm or a lower arm, which is a suspension part for a vehicle.

12. An upper arm or a lower arm that is a suspension part for a vehicle, that is produced by the method according to claim 1 or claim 2, and that has a branch in which metal flow at a center portion of a cross section of the branch run in a longitudinal direction of the branch.

13. The method according to claim 2, wherein the forging of the preform is performed in a state in which, in a cavity region of the second forging die in which a portion of the preform that has a thickness smaller than that of a corresponding portion of a forged product is subjected to forging, the surface region of the preform is located above a surface-layer-extruding section provided outside a section of the cavity, which section determines the shape of a forged product; and in a state in which, in a cavity region in which a portion of the preform that has a thickness greater than that of a corresponding portion of a forged product is subjected to forging, the surface region of the preform is located inward from an end, on a side of the section, of a portion of the cavity, which portion is provided outside the section and has a level equal to or lower than that of the section.

14. The method according to claim 1 or claim 2, wherein the first forging die has a space defined by a punch and die blocks such that a thickness T of the cylindrical forging material is (0.8 to 1.0)×(a lateral length t of a projection profile of the preform as viewed in a direction of pressure application).

15. The method according to claim 1 or claim 2, wherein the first forging die has a space defined by a punch and die blocks such that a volume V of the preform, a thickness T of the cylindrical forging material, a longitudinal length L of a projection profile of the preform as viewed in a direction of pressure application and a diameter R of the cylindrical forging material satisfy: $(1/3)\times L \leqq R = 2\times(VT\pi)^{1/2} \leqq L$.

* * * * *